US008780151B2

(12) United States Patent
Matsutani

(10) Patent No.: US 8,780,151 B2
(45) Date of Patent: Jul. 15, 2014

(54) PRINTER, NON-TRANSITORY COMPUTER-READABLE MEDIUM STORING CONTROL PROGRAM EXECUTABLE ON PRINTER, AND METHOD THAT IS EXECUTED BY PRINTER

(71) Applicant: Brother Kogyo Kabushiki Kaisha, Nagoya (JP)

(72) Inventor: Megumi Matsutani, Okazaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/788,346

(22) Filed: Mar. 7, 2013

(65) Prior Publication Data

US 2013/0258028 A1 Oct. 3, 2013

(30) Foreign Application Priority Data

Mar. 30, 2012 (JP) ..... 2012-079184

(51) Int. Cl.
*B41J 2/355* (2006.01)

(52) U.S. Cl.
CPC ..... *B41J 2/355* (2013.01)
USPC ..... 347/183

(58) Field of Classification Search
USPC ..... 347/9–11, 61, 62, 54, 183, 204–206
See application file for complete search history.

(56) References Cited

U.S. PATENT DOCUMENTS

| | | | | | |
|---|---|---|---|---|---|
| 5,363,125 | A * | 11/1994 | Inui et al. | ..... | 347/183 |
| 5,382,965 | A * | 1/1995 | Yamakawa et al. | ..... | 347/183 |
| 6,088,050 | A * | 7/2000 | Ng | ..... | 347/183 |
| 6,614,459 | B2 * | 9/2003 | Fujimoto et al. | ..... | 347/183 |

FOREIGN PATENT DOCUMENTS

| | | |
|---|---|---|
| JP | S62-55168 | 3/1987 |
| JP | H7-89115 | 4/1995 |

* cited by examiner

*Primary Examiner* — Kristal Feggins
(74) *Attorney, Agent, or Firm* — McCarter & English, LLP

(57) ABSTRACT

A printer includes a feeding portion, a printing portion, and a processor. The feeding portion is configured to feed a printing medium in a sub-scanning direction that is orthogonal to a main scanning direction. The printing portion includes a plurality of heating elements that are arrayed in the main scanning direction and that is configured to perform printing on the printing medium fed by the feeding portion when heating pulses are applied to the plurality of heating elements each corresponding to a single dot. A length of each of the plurality of heating elements in the sub-scanning direction is shorter than a length of each of the plurality of heating elements in the main scanning direction. The processor is configured to apply one or more heating pulses to one of the plurality of heating elements in response to a command to print one dot.

18 Claims, 21 Drawing Sheets

FIG. 11

9511

| TAPE TYPE | | TAPE A | |
|---|---|---|---|
| BASIC CONSTANT | | FIRST CONSTANT | SECOND CONSTANT |
| CONTROL PATTERN | A | 27700 | 27700 |
| | B | 36933 | 18467 |
| | C | 18467 | 36933 |
| | D | 18467 | 18467 |
| | E | 18467 | 0 |

FIG. 12

9521

| TAPE TYPE | TAPE A |
|---|---|
| VOLTAGE | DECIMAL DATA |
| 5.11 | 1241 |
| 5.40 | 1223 |
| 5.68 | 1215 |
| 5.97 | 1251 |
| 6.25 | 1353 |
| 6.54 | 1471 |
| 6.83 | 1604 |
| 7.11 | 1744 |
| 7.40 | 1890 |
| 7.68 | 2043 |
| 7.97 | 2201 |
| 8.26 | 2366 |
| 8.54 | 2538 |

FIG. 20

9551

| TEMPERATURE | TEMPERATURE A/D VALUE | COMPENSATION VALUE |
|---|---|---|
| 5°C | 186 | 0.885 |
| 10°C | 173 | 0.910 |
| 15°C | 156 | 0.949 |
| 20°C | 143 | 0.985 |
| 25°C | 129 | 1.032 |
| 35°C | 101 | 1.165 |
| 40°C | 88 | 1.255 |

PRINTER, NON-TRANSITORY COMPUTER-READABLE MEDIUM STORING CONTROL PROGRAM EXECUTABLE ON PRINTER, AND METHOD THAT IS EXECUTED BY PRINTER

CROSS-REFERENCE TO RELATED APPLICATION

This application claims priority to Japanese Patent Application No. 2012-079184 filed Mar. 30, 2012, the content of which is hereby incorporated herein by reference.

BACKGROUND

The present disclosure relates to a printer that is capable of printing on a printing medium by using a thermal head, to a non-transitory computer-readable medium that stores a control program executable on the printer, and to a method that is executed by the printer.

A printer is known that includes a thermal head that has a plurality of heating elements. The printer causes the individual heating elements to generate heat by applying electric current to the individual heating elements. The printer thus performs printing by one of producing color on heat-sensitive paper and using hot melt ink to transfer a pattern to recording paper. In printing control for the thermal head, within a printing cycle in which one dot is printed, there must be, for example, a heating pulse time period for performing the printing and a non-heating time period for cooling the thermal head after the heating is finished.

When the printing starts, as well as when an isolated dot that stands alone is printed in the course of the printing, more than a little of the energy that is applied for generating heat may be used for initially heating the area around the heating element to its thermal capacity. Accordingly, the applied energy may be slightly insufficient. In order to compensate for the energy shortfall, the printing may be performed by adding an auxiliary pulse within the printing cycle, prior to the regular heating pulse, for example. In the case of a printer that uses heating elements that correspond to 128 dots, as an example of the thermal head, the printing operation may be performed by replacing data with every line. The auxiliary pulse may not be required for a heating element that is heated continuously since the heating element has been used for printing a dot for the preceding line. Conversely, in a case where a heating element that corresponds to a dot that precedes a print dot in a sub-scanning direction of the thermal head has not generated heat, and in a case where heating elements that correspond to dots that precedes and follows a print dot in a main scanning direction of the thermal head have not generated heat, the auxiliary pulse may be required. Therefore, within the printing cycle, the auxiliary pulse, the heating pulse, and the non-heating time period may be required.

SUMMARY

In the printer that is described above, in a case where the printing speed is increased and the printing cycle is shortened, the pulses that are described above may not fall within the printing cycle. To form pulses suitable for the printing cycle, for example, the following methods are assumed: increasing the voltage that is applied to the heating elements of the thermal head; and increasing the electric current by lowering the resistance of the heating elements. In those cases, it would be necessary to increase the voltage resistance of the integrated circuit parts in the thermal head, or to increase the current capacities of the integrated circuits. For another method, it is assumed to increase the heat transfer efficiency to more efficiently transmit the heat from the heating elements to the printing medium. However, all of these methods may increase costs. In a case where the printing speed is increased and the printing cycle is shortened, the proportion of the printing cycle that is accounted for the heating pulse time period may increase, and the proportion of the printing cycle that is accounted for the non-heating time period may decrease. Therefore, the time period during which the raised temperature of a heating element falls may become shorter. Accordingly, blurring, smearing, or the like may occur in the printed characters due to the rise in the temperature of the thermal head during continuous printing.

Embodiments of the broad principles derived herein provide a printer that improves heating efficiency of a thermal head and allows high-density printing, a non-transitory computer-readable medium that stores a control program executable on the printer, and to a method that is executed by the printer.

Embodiments provide a printer that includes a feeding portion, a printing portion, and a processor. The feeding portion is configured to feed a printing medium in a sub-scanning direction that is orthogonal to a main scanning direction. The printing portion includes a plurality of heating elements that are arrayed in the main scanning direction and that is configured to perform printing on the printing medium fed by the feeding portion when heating pulses are applied to the plurality of heating elements each corresponding to a single dot. A length of each of the plurality of heating elements in the sub-scanning direction is shorter than a length of each of the plurality of heating elements in the main scanning direction. The processor is configured to apply one or more heating pulses to one of the plurality of heating elements in response to a command to print one dot.

Embodiments also provide a non-transitory computer-readable medium storing a control program executable on a printer. The printer includes a feeding portion and a printing portion. The feeding portion is configured to feed a printing medium in a sub-scanning direction that is orthogonal to a main scanning direction. The printing portion includes a plurality of heating elements that are arrayed in the main scanning direction and that is configured to perform printing on the printing medium fed by the feeding portion when heating pulses are applied to the plurality of heating elements each corresponding to a single dot. The program includes computer-readable instructions, when executed, to cause the printer to perform the step of applying one or more heating pulses to one of the plurality of heating elements in response to a command to print one dot. A length of each of the plurality of heating elements in the sub-scanning direction is shorter than a length of each of the plurality of heating elements in the main scanning direction.

Embodiments further provide a method that is executed by a printer. The printer includes a feeding portion and a printing portion. The feeding portion is configured to feed a printing medium in a sub-scanning direction that is orthogonal to a main scanning direction. The printing portion includes a plurality of heating elements that are arrayed in the main scanning direction and that is configured to perform printing on the printing medium fed by the feeding portion when heating pulses are applied to the plurality of heating elements each corresponding to a single dot. The method includes the step of applying one or more heating pulses to one of the plurality of heating elements in response to a command to print one dot. A length of each of the plurality of heating elements in the sub-scanning direction is shorter than a length of each of the plurality of heating elements in the main scanning direction.

BRIEF DESCRIPTION OF THE DRAWINGS

Embodiments will be described below in detail with reference to the accompanying drawings in which:

FIG. 11 is a conceptual diagram of a basic constant table;

FIG. 12 is a conceptual diagram of a decimal data table;

FIG. 20 is a conceptual diagram of a temperature compensation table; and

DETAILED DESCRIPTION

Figure 1:
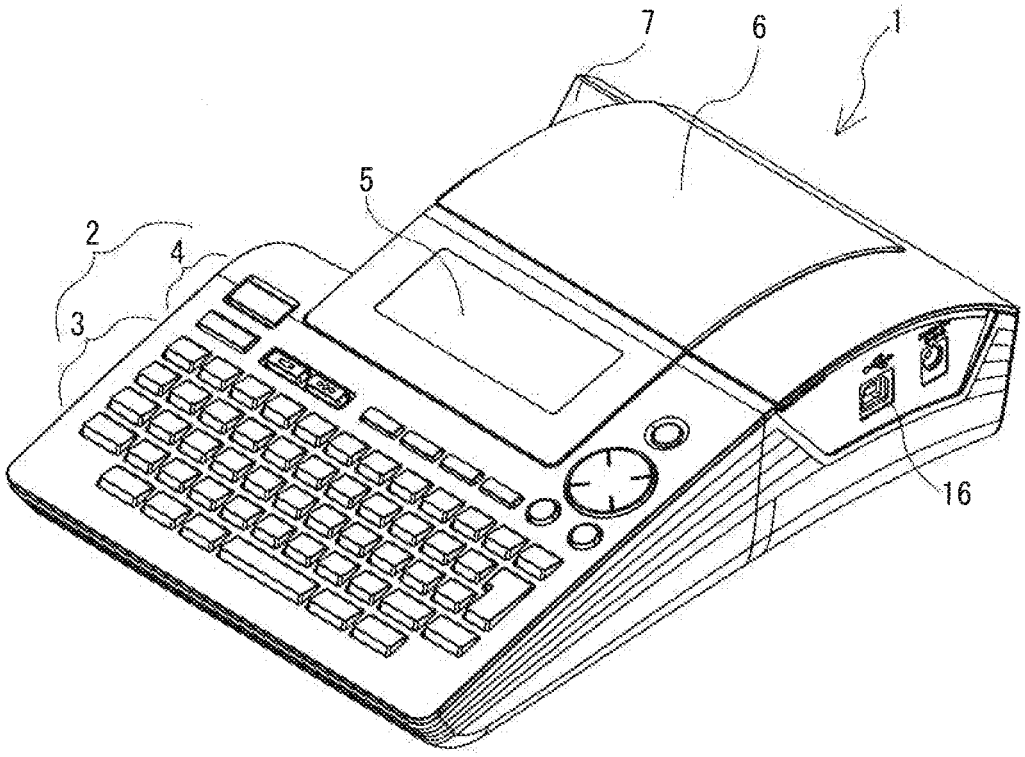
FIG. 1 is an oblique view of a tape printer.
Figure 2:
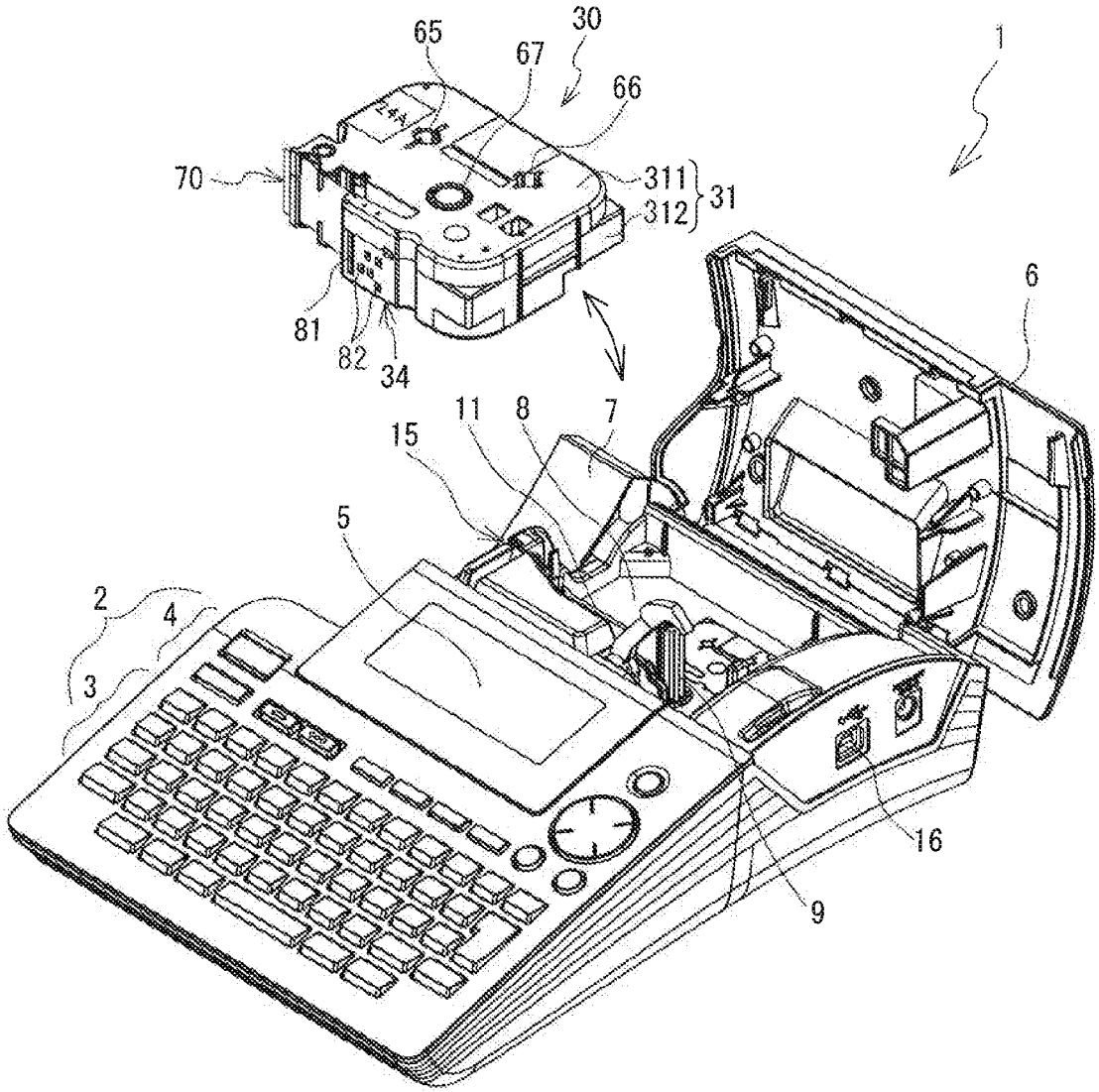
FIG. 2 is an oblique view of the tape printer, in a cassette mounting portion of which a tape cassette is to be mounted.

Hereinafter, an embodiment will be explained with reference to the drawings. Hereinafter, the lower left side, the upper right side, the lower right side, and the upper left side in FIGS. 1 and 2 are respectively defined as the front side, the rear side, the right side, and the left side of a tape printer 1.

The structure of the tape printer 1 will be explained briefly. As shown in FIG. 1, a keyboard 3 is provided on a front portion of a top face of the tape printer 1. The keyboard 3 is an input device that is used for inputting characters. The characters may be, for example, letters, symbols, graphics, numerals, and the like. A function key cluster 4 is provided at the rear of the keyboard 3. The function key cluster 4 is an input device that may include, for example, a Power key, a Set key, and a Print key. Hereinafter, in a case where the keyboard 3 and the function key cluster 4 are referenced collectively, the keyboard 3 and the function key cluster 4 are referred to as an input portion 2.

A display 5 is provided at the rear of the function key cluster 4. The display 5 may have a rectangular shape, for example, and the longitudinal direction of the display 5 may be in parallel to a tape discharge direction of the tape printer 1. The tape discharge direction may be, for example, a direction from a discharge outlet 15, which will be described below (refer to FIG. 2), toward the left side of the tape printer 1. The display 5 is configured to display various types of images.

A cover 6 is provided in the rear portion of the top face of the tape printer 1. The cover 6 has a substantially rectangular shape in a plan view. The rear edge of the cover 6 is axially supported at the rear of the top face of the tape printer 1. As shown in FIG. 2, the cover 6 can be opened and closed by centering on a rear edge of the cover 6. When the cover 6 is opened upward, a cassette mounting portion 8 is exposed. A user may mount a tape cassette 30 in the cassette mounting portion 8 with the cover 6 in the open state. The tape cassette 30 may be a general-purpose cassette in which various types of tapes can be mounted, such as a thermal type, a receptor type, a laminated type, and the like. The tape cassette 30 may, for example, discharge a laminated type of a tape 70. The tape cassette 30 may discharge a tape of the thermal type, the receptor type, or the like.

A USB connector 16 is provided in the rear portion of the right side face of the tape printer 1. A terminal of a USB cable, which is not shown in the drawings, may be connected to the USB connector 16. The tape printer 1 may be connected to a personal computer (PC) 200 (refer to FIG. 10), for example, via the USB cable. As shown in FIG. 2, the discharge outlet 15 is provided in the rear portion of the left side face of the tape printer 1. After being cut by a cutter mechanism (not shown in the drawings), the printed tape 70 may be discharged to the outside from the discharge outlet 15. A tape tray 7 is provided in the vicinity of the discharge outlet 15. The tape tray 7 may receive the printed tape 70 that has been discharged from the discharge outlet 15.

The internal structure of the cassette mounting portion 8 will be explained with reference to FIG. 2. The cassette mounting portion 8 includes a printing mechanism, a tape feed mechanism, and the cutter mechanism, which are known mechanisms. The printing mechanism includes a thermal head 10 (refer to FIG. 10) and a platen holder (not shown in the drawings). The thermal head 10 is supported by a head holder 11. The head holder 11 is provided in the front portion of the cassette mounting portion 8. The thermal head 10 includes heating elements. The thermal head 10 may print a character by pressing an ink ribbon 60 (refer to FIG. 3) against a printing surface of a film tape 59 (refer to FIG. 3) that has been pulled out of the tape cassette 30 and will be described below. The platen holder is provided in front of the head holder 11. The platen holder (not shown in the drawings) holds a platen roller and a feed roller at a left end of the platen holder such that the platen roller and the feed roller can rotate. The platen holder may rotate about a right end of the platen holder. When the platen holder rotates toward the rear, the platen roller may press against the thermal head 10. The feed roller press against a tape drive roller 46 of the tape cassette 30 (refer to FIG. 3).

The tape feed mechanism includes a ribbon winding shaft 9 and a tape drive shaft (not shown in the drawings), for example. The ribbon winding shaft 9 is provided in a vertical orientation substantially in the center of the cassette mounting portion 8. The ribbon winding shaft 9 may be rotated by being driven by a tape feed motor 15 (refer to FIG. 10) via a drive mechanism that is not shown in the drawings. The ribbon winding shaft 9 may wind up the ink ribbon 60 after the ink ribbon 60 has been pulled out from a ribbon spool 42 of the tape cassette 30, which will be described below (refer to FIG. 3), and has been used for printing. The tape drive shaft may also be rotated by being driven by the tape feed motor 15 via a drive mechanism that is not shown in the drawings. Therefore the ribbon winding shaft 9 and the tape drive shaft may be driven in synchronization with one another. The tape drive roller 46 of the tape cassette 30 may be fitted onto the tape drive shaft such that the tape drive shaft is inserted into the tape drive roller 46. The tape printer 1 may use the thermal head 10 to print the character by using the coordinated operations of the tape drive roller 46 and the feed roller to pull the film tape 59 out of the tape cassette 30. The tape printer 1 may also form the tape 70 by affixing a double-sided adhesive tape 58 to the printing surface of the film tape 59, then may feed the tape 70 toward the discharge outlet 15.

The cutter mechanism is provided in the middle of a feed path for the tape 70 between the thermal head 10 and the discharge outlet 15. The cutter mechanism includes a moving blade and a fixed blade that are not shown in the drawings, as well as a cutter motor 12 (refer to FIG. 10). The moving blade may be positioned above the feed path for the tape 70, for example. The fixed blade may be positioned below the feed path, for example. The positions of the moving blade and the fixed blade may be reversed. When the cutter motor 12 is driven by an operation of the input portion 2, the moving blade is moved toward the fixed blade. Thus the printed tape 70 that is positioned between the moving blade and the fixed blade may be cut in the width direction of the printed tape 70.

An optical sensor 25 (refer to FIG. 10) and a cassette identification sensor 26 (refer to FIG. 10) are provided in the front portion of the cassette mounting portion 8. The optical sensor 25 is configured to detect, through a slit 81 (refer to FIG. 2), an end mark (not shown in the drawings) or the like, for example, that is provided on the film tape 59 that is fed within the tape cassette 30. The slit 81 is provided in an arm portion 34 of the tape cassette 30. The end mark, for example, indicates the end of the film tape 59. The cassette identification sensor 26 includes a plurality of through-holes and a detection sensor panel, for example. The detection sensor panel is provided with a detection switch. The detection switch is provided with a plurality of plungers. The plurality of plungers project toward the rear from the plurality of through-holes. A plurality of identification holes 82 (refer to FIG. 2) are provided in the arm portion 34 of the tape cassette 30. Based on the combination of plurality of identification holes 82, the detection switch is configured to detect the type of the tape cassette 30 that has been mounted in the cassette mounting portion 8.

The structure of the tape cassette 30 will be explained with reference to FIGS. 2 and 3. The tape cassette 30 may be the laminated type, for example. As shown in FIG. 2, the tape cassette 30 includes a cassette case 31. The cassette case 31 is a substantially rectangular housing. The corners, as seen in a plan view, are rounded. The cassette case 31 includes a top case 311 and a bottom case 312. The top case 311 is affixed to the top of the bottom case 312. Support holes 65, 66, 67 are provided in the top case 311 and the bottom case 312, and each of the support holes 65, 66, 67 may support a spool that will be described below, such that the spool may rotate.

Figure 3:
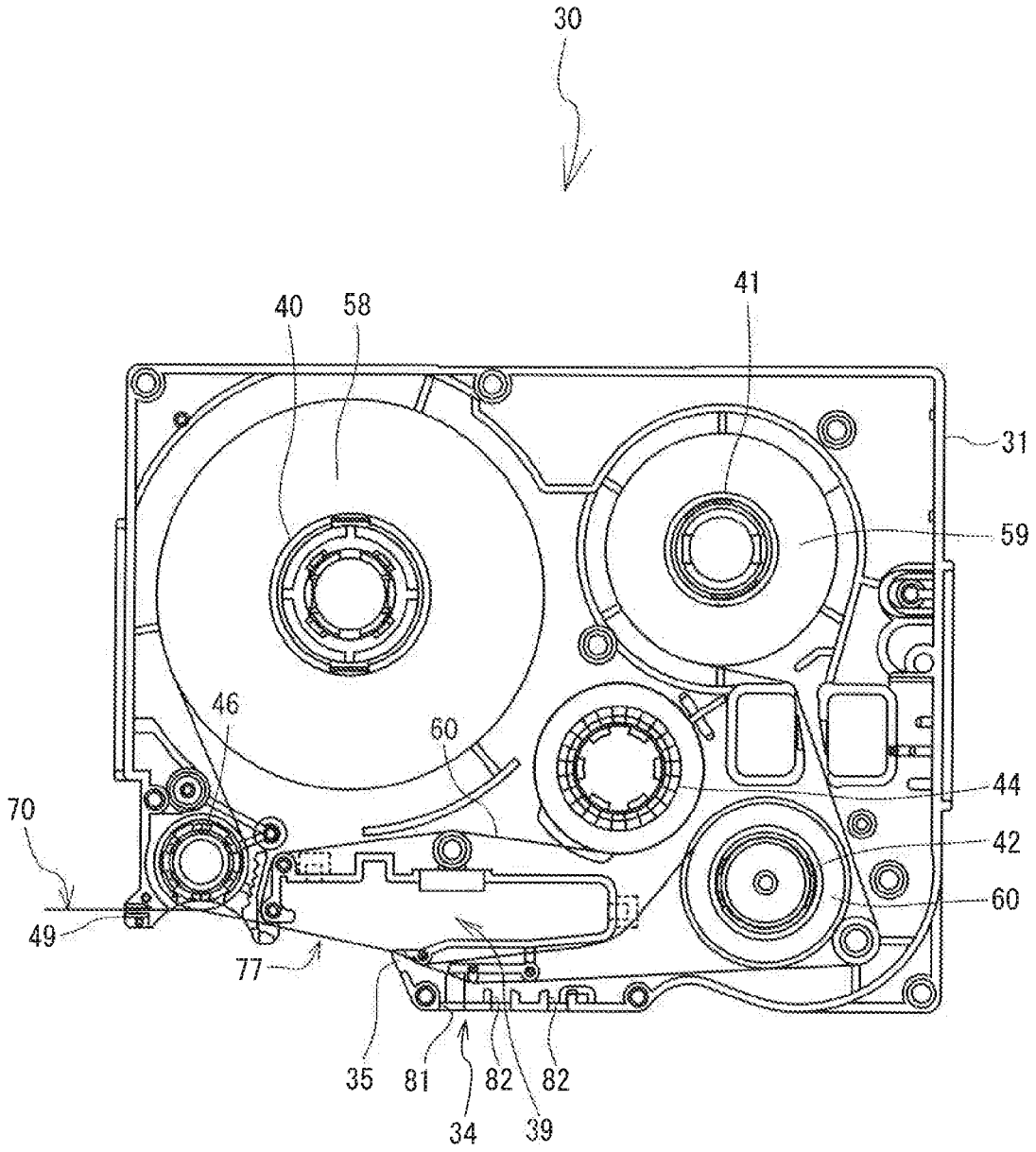
FIG. 3 is a figure that shows an internal structure of the tape cassette.

As shown in FIG. 3, the cassette case 31 contains three types of tape rolls, for the double-sided adhesive tape 58, the transparent film tape 59, and the ink ribbon 60, for example. A first tape spool 40, a second tape spool 41, the ribbon spool 42, the ribbon winding spool 44, and the like are provided inside the cassette case 31. The first tape spool 40 is disposed in the left rear portion inside the cassette case 31, in such a way that the first tape spool 40 may rotate via the aforementioned support hole 65. The second tape spool 41 is disposed in the right rear portion inside the cassette case 31, in such a way that the second tape spool 41 may rotate via the aforementioned support hole 66. The ribbon spool 42 is rotatably disposed in the right front portion inside the cassette case 31. The ribbon winding spool 44 is disposed between the first tape spool 40 and the ribbon spool 42, in such a way that the ribbon winding spool 44 may rotate via the aforementioned support hole 67.

The double-sided adhesive tape 58 is wound around the first tape spool 40. The double-sided adhesive tape 58 is a double-sided tape with a release paper affixing to one side. The double-sided adhesive tape 58 is wound around the first tape spool 40 with the release paper facing outward. The double-sided adhesive tape 58 is to be affixed to the print surface side of the printed film tape 59. The film tape 59 is wound around the second tape spool 41. The ink ribbon 60 is wound around the ribbon spool 42. Hereinafter, the upstream side and the downstream side in the feed direction of the film tape 59 is respectively referred to as the upstream side in the feed direction and the downstream side in the feed direction.

The ribbon winding shaft 9 (refer to FIG. 2) may be inserted into the interior of the ribbon winding spool 44. The ribbon winding spool 44 may be rotationally driven by the ribbon winding shaft 9. The tape drive roller 46 is rotatably supported at the downstream side in the feed direction from a head insertion portion 39, which will be described below. The tape drive shaft (not shown in the drawings) may be inserted into the interior of the tape drive roller 46. The tape drive roller 46 may be rotationally driven by the tape drive shaft.

The cassette case 31 includes the arm portion 34. The arm portion 34 is a portion that extends to the left from the right front corner of the tape cassette 30. The film tape 59 that has been pulled out from the second tape spool 41 and the ink ribbon 60 that has been pulled out from the ribbon spool 42 may both be guided within the arm portion 34. The tip end of the arm portion 34 is curved somewhat toward the rear. An opening 35 is provided at the tip end of the arm portion 34. At the opening 35, the film tape 59 and the ink ribbon 60 may be discharged toward an open portion 77 in a state of being superposed on one another. The open portion 77 is a space that is provided on the front face side of the tape cassette 30.

The head insertion portion 39 is a space that is bounded by the front face of the cassette case 31 and the rear face of the arm portion 34. Through the open portion 77, the head insertion portion 39 is connected to the outside at the front face side of the tape cassette 30. The head holder 11 may be inserted into the head insertion portion 39. The head holder 11 is a member that supports the thermal head 10 (refer to FIG. 10). At the open portion 77, one face of the film tape 59 that has been discharged from the opening 35 may be exposed toward the front. The other face of the film tape 59 may face the thermal head 10, with the ink ribbon 60 interposed between the thermal head 10 and the film tape 59. At the open portion 77, the printing on the film tape 59 may be performed via the ink ribbon 60 by the thermal head 10.

The operation of printing by the tape printer 1 will be explained briefly with reference to FIGS. 2 and 3. A case will be explained in which the laminated type of the tape cassette 30 has been mounted in the tape printer 1. First, the tape drive roller 46 may be rotationally driven via the tape drive shaft. By operating in coordination with the feed roller, the tape drive roller 46 may pull the film tape 59 out from the second tape spool 41. The ribbon winding spool 44 may be rotationally driven via the ribbon winding shaft 9. The ribbon winding spool 44 may pull the unused ink ribbon 60 out from the ribbon spool 42 in synchronization with the printing speed. As the film tape 59 that has been pulled out may pass by the outer side of the ribbon spool 42, and may be fed along the feed path inside the arm portion 34.

The film tape 59 may be supplied from the opening 35 to the head insertion portion 39 in the state in which the ink ribbon 60 has been superposed on the surface of the film tape 59, and then may be fed between the thermal head 10 and the platen roller. Then a character may be printed on the printing surface of the film tape 59 by the thermal head 10, starting from the downstream side in the feed direction. Thereafter, the used ink ribbon 60 may be peeled away from the printed film tape 59 and may be wound up by the ribbon winding spool 44.

The double-sided adhesive tape 58 may be pulled out from the first tape spool 40 by the coordinated operations of the tape drive roller 46 and the feed roller. As the double-sided adhesive tape 58 that has been pulled out is guided between the tape drive roller 46 and the feed roller, the double-sided adhesive tape 58 may be superposed on and affixed to the print surface of the printed film tape 59. The printed film tape 59 to which the double-sided adhesive tape 58 has been affixed may become the tape 70 and may be fed toward a tape discharge outlet 49.

Figure 4:
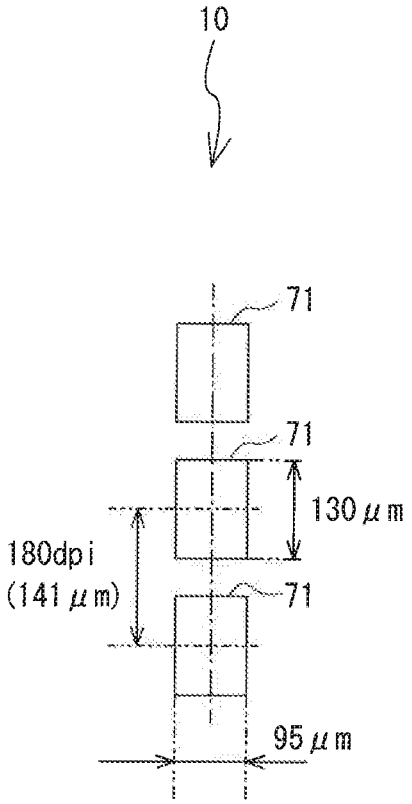
FIG. 4 is a figure that shows a size of a heating element of a thermal head.

The size of a heating element 71 of the thermal head 10 will be explained with reference to FIG. 4. A representative known thermal head, for example, includes a plurality of heating elements. The plurality of the heating elements may be arrayed at a specified pitch in a main scanning direction, for example. Each of the heating elements has a rectangular shape. The length of each of the heating elements in the main scanning direction may be 130 μm, for example. The length of each of the heating elements in a sub-scanning direction may be 195 μm, for example. The sub-scanning direction is a direction that is orthogonal to the main scanning direction, and is also the feed direction of the tape 70. The specified pitch may be the distance from the center of one of the heating elements to the center of the adjacent heating element, for example. The specified pitch may be 141 μm (180 dpi), for example. In other words, the size of the known heating element is such that a length of the heating element in the auxiliary scanning direction is greater than a length of the heating element in the main scanning direction.

In contrast, the dimensions of the heating element 71 of the thermal head 10 in the present embodiment are different from the dimensions of the known heating element. The thermal head 10 includes a plurality of the heating elements 71. The plurality of the heating elements 71 are arrayed at a specified pitch in the main scanning direction. Each of the heating elements 71 is rectangular. The length of each of the heating elements 71 in the main scanning direction is the same as in the known heating element. The length in the sub-scanning direction may be 95 μm, for example. In other words, the length of the heating element 71 in the sub-scanning direction is shorter than the length of the heating element 71 in the main scanning direction. Therefore, the heat generation efficiency of the heating element 71 of the present embodiment can be improved over that of the known heating element. The electric power that is consumed can be conserved accordingly. It is unnecessary to raise the temperature of the heating element 71 above what is required. Problems such as sticking and the like, for example, can therefore be prevented.

Current application control and current application control patterns in the printing of one dot in the present embodiment will be explained with reference to FIGS. 5 to 9. The tape printer 1 may perform the printing of one dot within a printing cycle t, for example, by using one of one and two heating pulses. The heating pulses include a heating pulse P1 and a heating pulse P2, for example. The application durations (pulse widths) for the heating pulses P1 and P2 and the ratio of the pulse widths for the heating pulses P1 and P2 may be varied according to data on the area around the print dot, the ambient temperature in the tape printer 1, the temperature of the heating element 71, the printing speed, the number of ON dots in one line, the elapsed time since the printing started, the magnitude of the power supply voltage, the range of fluctuation in the power supply voltage, and the like, for example. Control patterns of the current application for the printing of the one dot by the heating pulses P1 and P2 may include five types of control patterns, A to E, for example. The current application control patterns for the heating pulses P1 and P2 are different for each of the control patterns A to E.

In the present embodiment, data replacement is required in order to change the duration of the current application for the heating pulses P1 and P2. The print density in the sub-scanning direction can be increased by replacing the data within the printing cycle t. High-quality printing thus may become possible. Hereinafter, each of the control patterns A to E will be explained in detail. In FIGS. 5 to 9, $t_0$ to $t_3$ indicate individual times within the printing cycle t. Their relationship may be $t_0<t_1<t_2<t_3$, for example.

The control pattern A will be explained with reference to FIG. 5. With the control pattern A, within the printing cycle t, first the heating pulse P1 is applied, and then the heating pulse P2 is applied. The application durations (pulse widths) for the heating pulses P1 and P2 are equal, and the cycles for the heating pulses P1 and P2 are equal, for example. Therefore, a temperature curve for the control pattern A shows a curve that exhibits two peaks, with the areas under the peaks being equal. In this case, at $t_0$, a first data transmission to the thermal head 10 is performed. Then, at $t_2$, a second data transmission is performed. $t_2$ may be a time at which one-half of the printing cycle t has elapsed, for example. For the first peak in the temperature curve for the control pattern A, a maximum temperature is reached at $t_a$, while for the second peak, the maximum temperature is reached at $t_b$. $t_a$ lies between $t_0$ and $t_2$. $t_b$ comes after $t_2$.

The control pattern B will be explained with reference to FIG. 6. With the control pattern B, within the printing cycle t, first the heating pulse P1 is applied, and then the heating pulse P2 is applied. The pulse width for the heating pulse P1 is greater than the pulse width for the heating pulse P2. The cycle for the heating pulse P1 is longer than the cycle for the heating pulse P2. Therefore, in the temperature curve for the control pattern B, the area under the first peak is greater than the area under the second peak. In this case, at $t_0$, the first data transmission to the thermal head 10 is performed. Then, at $t_3$, the second data transmission is performed. For the first peak in the temperature curve for the control pattern B, the maximum temperature is reached at $t_c$, while for the second peak, the maximum temperature is reached at $t_d$. $t_c$ lies between $t_0$ and $t_3$. $t_d$ comes after $t_3$. The control pattern B can compensate for an energy shortfall in the area around the heating element 71 or the entire thermal head 10 when printing starts, for example.

The control pattern C will be explained with reference to FIG. 7. With the control pattern C, within the printing cycle t, first the heating pulse P1 is applied, and then the heating pulse P2 is applied. The pulse width for the heating pulse P1 is less than the pulse width for the heating pulse P2. The cycle for the heating pulse P1 is shorter than the cycle for the heating pulse P2. Therefore, in the temperature curve for the control pattern C, the area under the first peak is less than the area under the second peak. In this case, at $t_0$, the first data transmission to the thermal head 10 is performed. Then, at $t_1$, the second data transmission is performed. For the first peak in the temperature curve for the control pattern C, the maximum temperature is reached at $t_e$, while for the second peak, the maximum temperature is reached at $t_f$. $t_e$ lies between $t_0$ and $t_1$. $t_f$ comes after $t_1$. The control pattern C makes it possible to perform heating that is appropriate for an initial period of heat accumulation in the area around the thermal head 10, for example.

The control pattern D will be explained with reference to FIG. 8. With the control pattern D, within the printing cycle t, first the heating pulse P1 is applied, and then the heating pulse P2 is applied. The pulse widths are small for both the heating pulse P1 and the heating pulse P2. Therefore, in the temperature curve for the control pattern D, a large gap is opened between the first peak and the second peak. In this case, at $t_0$, the first data transmission to the thermal head 10 is performed. Then, at $t_3$, the second data transmission is performed. For the first peak in the temperature curve for the control pattern D, the maximum temperature is reached at $t_g$, while for the second peak, the maximum temperature is reached at $t_h$. $t_g$ lies between $t_0$ and $t_1$. $t_h$ comes after $t_3$. The control pattern D makes it possible to perform heating that is appropriate for a later period of heat accumulation in the area around the thermal head 10, for example.

Figure 9:
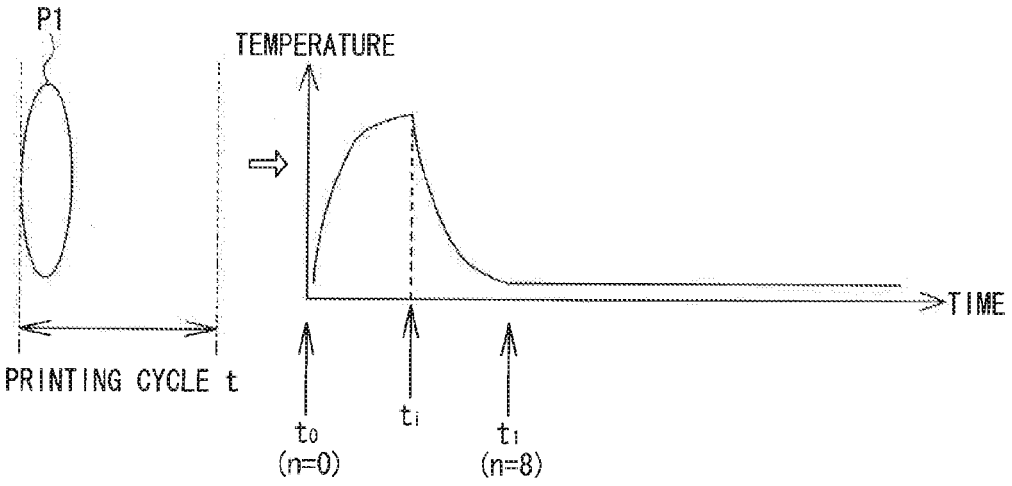
FIG. 9 is a figure that shows a representation of heating pulses and a temperature curve for a control pattern E.

The control pattern E will be explained with reference to FIG. 9. With the control pattern E, within the printing cycle t, the heating pulse P1 is applied, and the heating pulse P2 is not applied. Therefore, the temperature curve for the control pattern E exhibits only the first peak. In this case, at $t_0$, the first data transmission to the thermal head 10 is performed. The temperature curve for the control pattern E reaches its maximum temperature at $t_i$. $t_i$ lies between $t_0$ and $t_1$. By not applying the heating pulse P2 in the second half, the control pattern E is able to conserve the electric power that is consumed in a case where, for example, the printing has ended or the temperature of the heating element 71 has become not less than a specified temperature.

Figure 10:
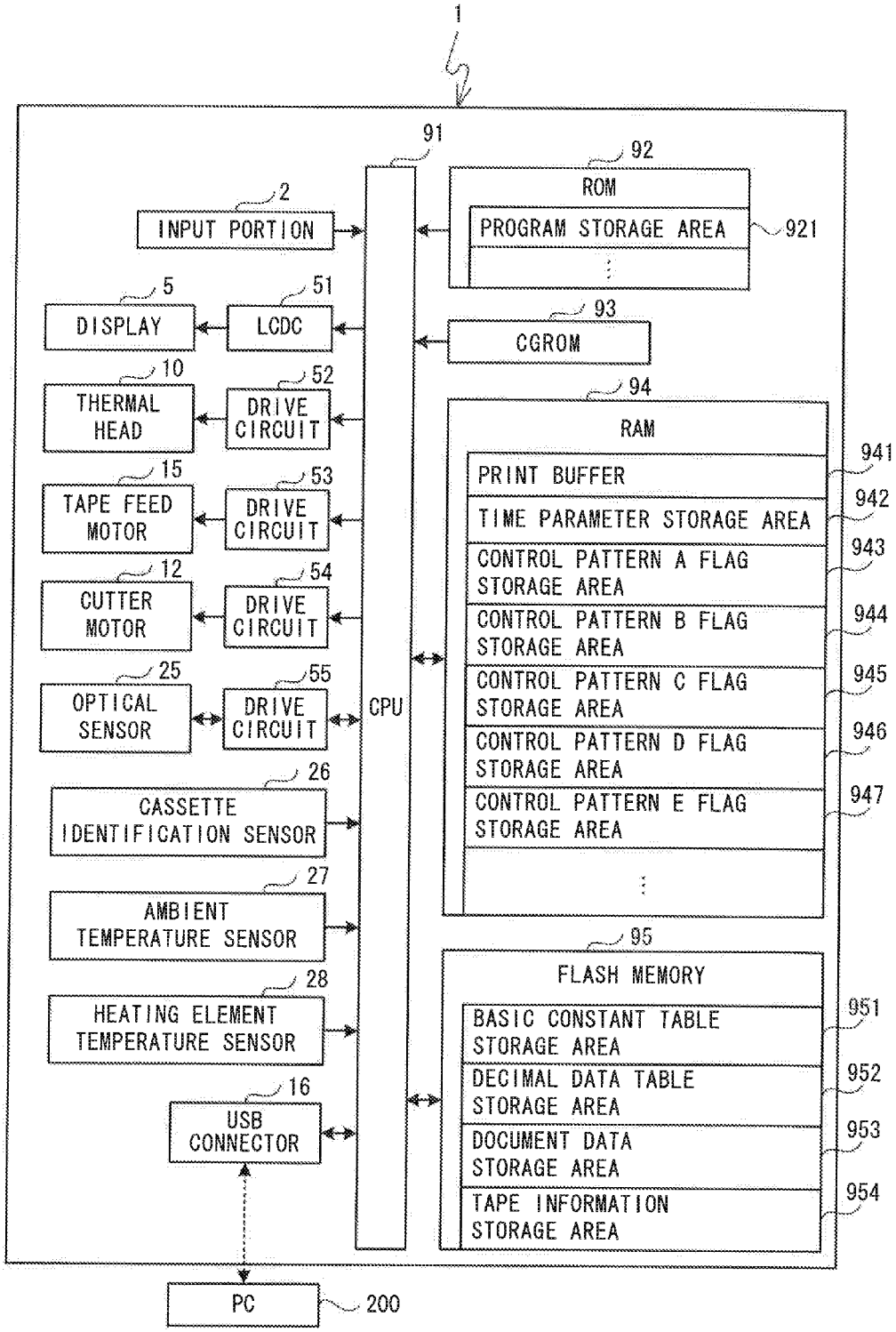
FIG. 10 is a block diagram that shows an electrical configuration of the tape printer.

An electrical configuration of the tape printer 1 will be explained with reference to FIG. 10. The tape printer 1 includes a CPU 91, a ROM 92, a CGROM 93, a RAM 94, a flash memory 95, and the like. The CPU 91 may perform overall control of the operations of the tape printer 1. The ROM 92, the CGROM 93, the RAM 94, and the flash memory 95 are electrically connected to the CPU 91. The input portion 2, which is described above, an LCDC 51, drive circuits 52 to 55, the cassette identification sensor 26 which is described above, an ambient temperature sensor 27, a heating element temperature sensor 28, the USB connector 16, and the like are also connected to the CPU 91. The LCDC 51 may drive the display 5. The drive circuit 52 may drive the thermal head 10. The drive circuit 53 may drive the tape feed motor 15. The drive circuit 54 may drive the cutter motor 12. The drive circuit 55 may drive the optical sensor 25. The ambient temperature sensor 27 may be provided in the cassette mounting portion 8, for example. The ambient temperature sensor 27 may detect the ambient temperature of the tape printer 1. The heating element temperature sensor 28 may be provided in the vicinity of the heating elements 71 of the thermal head 10 (refer to FIG. 4), for example. The heating element temperature sensor 28 may detect the temperature in the vicinity of the heating elements 71, for example.

The ROM 92 includes a program storage area 921 and the like. The program storage area 921 stores various types of programs for controlling the tape printer 1. The CGROM 93 stores size information for displaying characters on the display 5, printing dot pattern data for printing characters, and the like.

The RAM 94 includes a print buffer 941, a time parameter storage area 942, a control pattern A flag storage area 943, a control pattern B flag storage area 944, a control pattern C flag storage area 945, a control pattern D flag storage area 946, a control pattern E flag storage area 947, and the like. The print buffer 941 stores a print dot pattern in image data that are used during printing. The time parameter storage area 942 stores a time parameter n. The control pattern A to control pattern E flag storage areas 943 to 947 store control flags. The control flags are information items for setting one of a first part (a first round of current application) and a second part (a second round of current application) within one printing cycle under each of the control pattern A to the control pattern E, for example. For example, for the first part of the one printing cycle, the control flag is set to 1, and for the second part of the one printing cycle, the control flag is set to 2.

The flash memory 95 includes a basic constant table storage area 951, a decimal data table storage area 952, a document data storage area 953, a tape information storage area 954, and the like, for example. The basic constant table storage area 951 stores a basic constant table 9511 (refer to FIG. 11), which will be described below, for each type of tape. The decimal data table storage area 952 stores a decimal data table 9521 (refer to FIG. 12), which will be described below, for each type of tape. The document data storage area 953 stores document data. The document data may include, for example, image data for printing on the film tape 59. For example, document data for various types of patterns that the user has created using the input portion 2 may be stored in the document data storage area 953. Document data that have been received from the PC 200 may also be stored in the document data storage area 953. The tape information storage area 954 stores tape information. For each type of the tape cassette 30, the tape information includes basic information such as the type of tape (the thermal type, the receptor type, the laminated type, and the like), the tape width, the tape material, and the like, for example.

The basic constant table 9511 will be explained with reference to FIG. 11. The basic constant table 9511 may pertain to a tape A, for example. The tape A is an example of a type of tape on which the tape printer 1 can print. The basic constant table 9511 stores basic constants for the tape A. The basic constants vary according to the type of the printing medium (or the type of the cassette). It is therefore possible that the duration of the current application is varied. As described above, the current application control in the present embodiment may apply one of one and two pulses of electric current within the printing cycle t. It is therefore necessary to change the basic constant according to whether it is the first part or the second part of the printing cycle. Furthermore, the times at which the heating pulses P1 and P2 are applied are different among the control pattern A to the control pattern E. It is therefore necessary to set the basic constants in correspondence to the individual controls, from the control pattern A to the control pattern E. The basic constant table 9511 stores the basic constants for the first part and the second part of the printing cycle for each of the current application control patterns, from the control pattern A to the control pattern E.

For example, for the control pattern A, the basic constant for the first part of the printing cycle (hereinafter referred to as the first constant) is 27700, and the basic constant for the second part (hereinafter referred to as the second constant) is 27700. For the control pattern B, the first constant is 36933, and the second constant is 18467. For the control pattern C, the first constant is 18467, and the second constant is 36933. For the control pattern D, the first constant is 18467, and the second constant is 18467. For the control pattern E, the first constant is 18467, and the second constant is zero. The ratios of the first constant and the second constant for each of the current application control patterns correspond to the respective pulse widths of the heating pulses P1 and P2 for that particular current application control pattern, for example.

The decimal data table 9521 will be explained with reference to FIG. 12. The decimal data table 9521 stores decimal data items, each of which corresponds to one of the applied voltages that are used for the tape A. For example, in a case where the applied voltage is low, the value of the decimal data item is small, and in a case where the applied voltage is high, the value of the decimal data item is large. As will be explained below, the duration of the current application is controlled by subtracting the decimal data item that corresponds to the applied voltage from the basic constant for the current application control pattern until the result becomes not greater than zero. Therefore, in a case where the applied voltage is low, for example, the duration of the current application of the heating pulse becomes longer in order to compensate for the shortfall in the applied energy. Conversely, in a case where the applied voltage is high, the duration of the current application of the heating pulse becomes shorter in order to prevent an excess of the applied energy.

Figure 13:
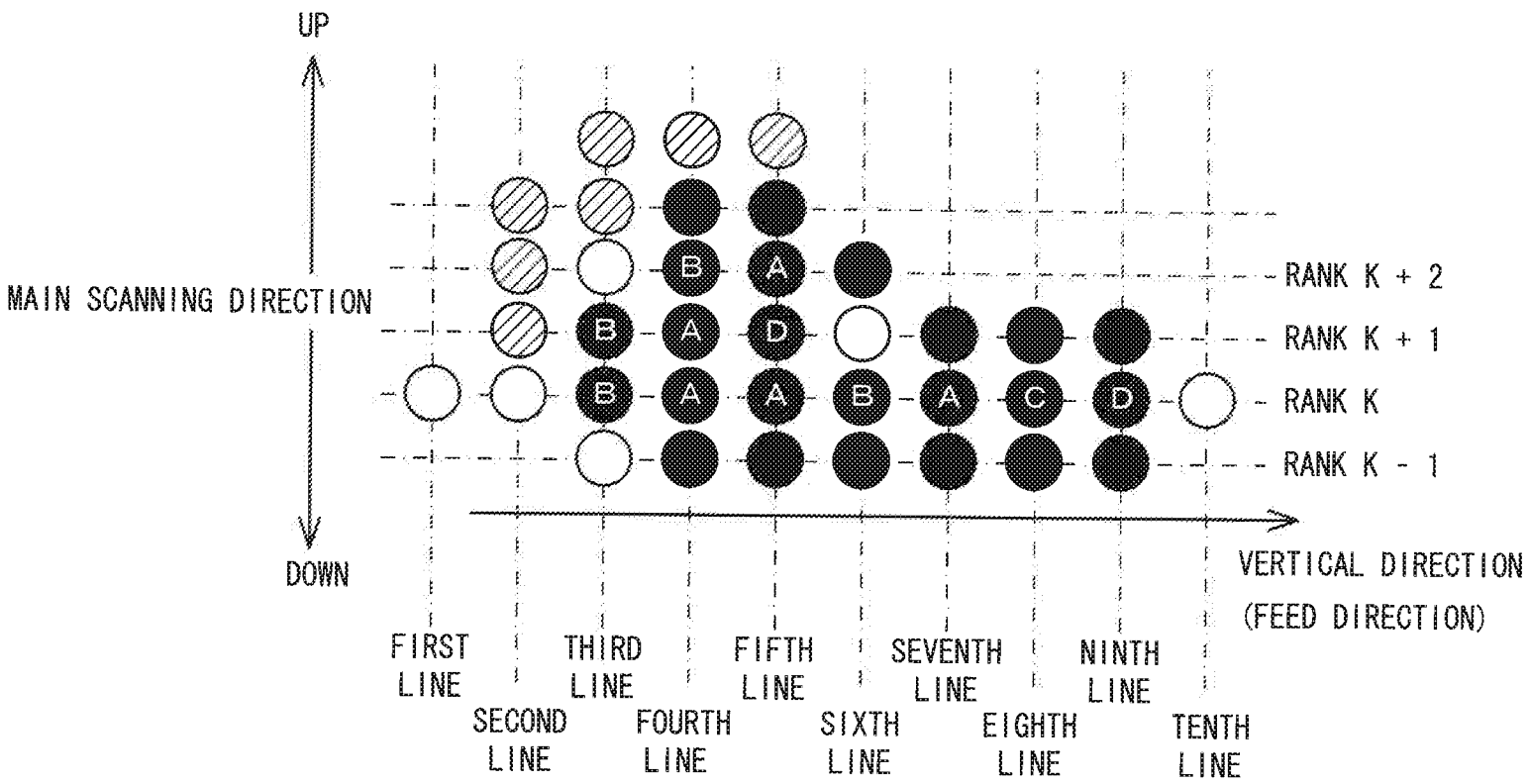
FIG. 13 is a figure that shows an example of current application control for individual dots in individual lines.

A method for setting the current application control pattern according to the relationship to the data for the area around the print dot will be explained with reference to FIG. 13. FIG. 13 shows a portion of a print dot pattern in a set of image data, for example. Each circular mark is equivalent to one dot. In the thermal head 10, the application of the electric current to the plurality of the heating elements 71 that are lined up in the main scanning direction is controlled separately for each individual line. A black and white dot pattern (of unprinted dots and print dots) is thus formed for each individual line. The black circular dots indicate the print dots that are printed by the heating of the heating elements 71. The white circular dots indicate the unprinted dots that are not printed by the heating elements 71 that are not heated. The dots other than the black circular dots and the white circular dots (the dots that are filled with diagonal lines) may be either printed dots or unprinted dots in the present example. The letters A to D on the black circular dots respectively indicate the control pattern A to the control pattern D that are the current application control patterns that are described above. The explanation of the present example will be limited to the three ranks of K, K+1, and K+2 in the first to the tenth lines. As shown in FIG. 13, the direction from the rank K+2 to the rank K−1 is from up to down in the main scanning direction. Hereinafter, a dot that is one rank above a given dot is referred to as the dot above, and a dot that is one rank below a given dot is referred to as the dot below.

The print dot in the rank K of the third line is printed using the control pattern B. The dot in the rank K of the preceding line (the rank K of the second line) and the dot in the rank K−1 of the third line are both unprinted dots. It is therefore possible that the energy is to be insufficient in the area around the heating element 71 that corresponds to the print dot in the rank K of the third line or even in the entire thermal head 10. Accordingly, the energy insufficiency can be eliminated by performing the printing using the control pattern B. The preceding line is the line that was the target of printing before the printing of the line that is currently the target of printing. The print dot in the rank K+2 of the fourth line is also printed using the control pattern B, because the dot in the preceding line (the rank K+2 of the third line) is an unprinted dot. The dot in the rank K+2 of the third line, the same line as the print dot in the rank K+1 of the third line, is an unprinted dot. It is therefore possible that the energy is to be insufficient in the area around the heating element 71 that corresponds to the print dot in the rank K+1 of the third line or even in the entire thermal head 10. Accordingly, the energy insufficiency can be eliminated by performing the printing using the control pattern B. The print dot in the rank K of the sixth line is also printed using the control pattern B, because the dot in the rank K+1 of the same sixth line is an unprinted dot.

The print dots in the rank K of the fourth, fifth, and seventh lines are printed using the control pattern A. The dots that precede and follow the print dots in the rank K of the fourth, fifth, and seventh lines, as well as the dots in the rank K+1 and the rank K−1 of the same set of lines, are all print dots. Therefore, printing using the control pattern A makes it possible to perform stable, high-quality printing. For the same reason, the print dot in the rank K+1 of the fourth line and the print dot in the rank K+2 of the fifth line are also printed using the control pattern A.

The print dot in the rank K of the eighth line is printed using the control pattern C. The dots that precede and follow the print dot in the rank K of the eighth line, as well as the dots in the rank K+1 and the rank K−1 of the same line, are all print dots. Moreover, a specified number (five, for example) of the print dots are lined up in succession in the same rank. Therefore, a state may exist in which heat has accumulated in the area around the heating element 71 that corresponds to the print dot in the rank K of the eighth line or even in the entire thermal head 10. In this case, printing using the control pattern C makes it possible to increase the print density in the sub-scanning direction and to perform stable, high-quality printing.

The printed dot in the rank K+1 of the fifth line and the print dot in the rank K of the ninth line are printed using the control pattern D. The dot in the rank K+1 of the sixth line and the dot in the rank K of the tenth line are unprinted dots. Therefore, it is not necessary to accumulate heat for the printing of the next line in the area around the heating element 71 that corresponds to the print dot in the rank K+1 of the fifth line or in the thermal head 10. In this case, the electric power that is consumed can be conserved by performing the printing using the control pattern D and reducing the pulse widths for both the heating pulse P1 and the heating pulse P2.

Thus, in the control pattern B, relative importance is placed on the heating pulse P1 for the printing of the one dot, in order to reduce the energy shortfall when the printing starts. Therefore, the temperature of the heating element 71 reaches its peak in the first part of the printing cycle. In the control pattern C, relative importance is placed on the heating pulse P2. Therefore, the temperature of the heating element 71 reaches its peak in the second part of the printing cycle. The temperature that has been built up in the heating element 71 in the preceding line is thus reduced.

In a state in which print dots have been printed in succession in the preceding lines and heat has accumulated in the heating element 71, the possibility arises that smearing is to occur in the printing in an area where a change is made from a print dot to an unprinted dot. Accordingly, in order to reduce smearing and blurring, one of the control pattern D and the control pattern E is used, depending on the conditions for the printed dots in the next and subsequent lines. The next line is the line that is to be the target of printing after the printing of the line that is currently the target of printing.

Main processing that the CPU 91 performs will be explained with reference to the flowchart in FIG. 14. When the power supply is turned on, for example, the CPU 91 reads a control program that is stored in the ROM 92 and performs the main processing. First, the CPU 91 performs printing data acquisition processing (Step S1). The printing data acquisition processing is processing that acquires printing data that has been created by using the input portion 2, or printing data that has been transmitted from the PC 200, for example. The acquired printing data may be displayed on the display 5, for example, and may be editable. An error may be displayed on the display 5. Next, the CPU 91 determines whether the printing has started (Step S2). The user may check the printing data that are displayed on the display 5 and may press the Power key of the input portion 2, for example. As long as the Power key has not been pressed and the printing has not been started (NO at Step S2), the CPU 91 waits.

In a case where the CPU 91 determines that the printing has started (YES at Step S2), the ambient temperature sensor 27 detects the ambient temperature (Step S3). The CPU 91 stores the detected ambient temperature in the RAM 94, for example. The CPU 91 performs the current application control of the thermal head 10 in accordance with the detected ambient temperature. The CPU 91 specifies the type of tape (Step S4). The CPU 91 uses the cassette identification sensor 26 to detect the type of the tape cassette 30. The CPU 91 also references the tape information that is stored in the flash memory 95 and specifies the type of tape (for example, the tape A) in the tape cassette 30. In the print buffer 941, the CPU 91 expands the printed dot pattern for the image data. For example, in a case where the document data that are stored in the document data storage area 953 are character strings, the document data are stored as text code. Therefore, the text code is converted into the printed dot pattern.

The CPU 91 turns on the tape feed motor 15 (Step S5). The CPU 91 determines whether the feeding of the tape 70 by a margin amount has been finished (Step S6). In a case where the feeding of the tape 70 by the margin amount has not been finished (NO at Step S6), the CPU 91 returns to the processing at Step S5 and continues the feeding of the tape 70. A margin is thus created on the tape 70. In a case where the feeding of the tape 70 by the margin amount has been finished (YES at Step S6), the CPU 91 acquires the data for the one line that is the line that is the target of printing, as well as the data for one line that precedes the line that is the target of printing and three lines that follow the line that is the target of printing (Step S7). The data that is to be acquired include ON and OFF information for each of the dots. For example, the print dots are indicated as ON, and the unprinted dots are indicated as OFF. The CPU 91 uses the heating element temperature sensor 28 to detect the temperatures of the heating elements 71 as temperature A/D values (Step S8). The temperature A/D value is a value that is acquired when the value of the temperature of the heating element is converted from analogue to digital. The CPU 91 stores the detected heating element temperatures (the temperature A/D values) in the RAM 94, for example. Processing at Step S8 may be omitted. The CPU 91 performs control pattern setting processing (Step S9).

Figure 15:
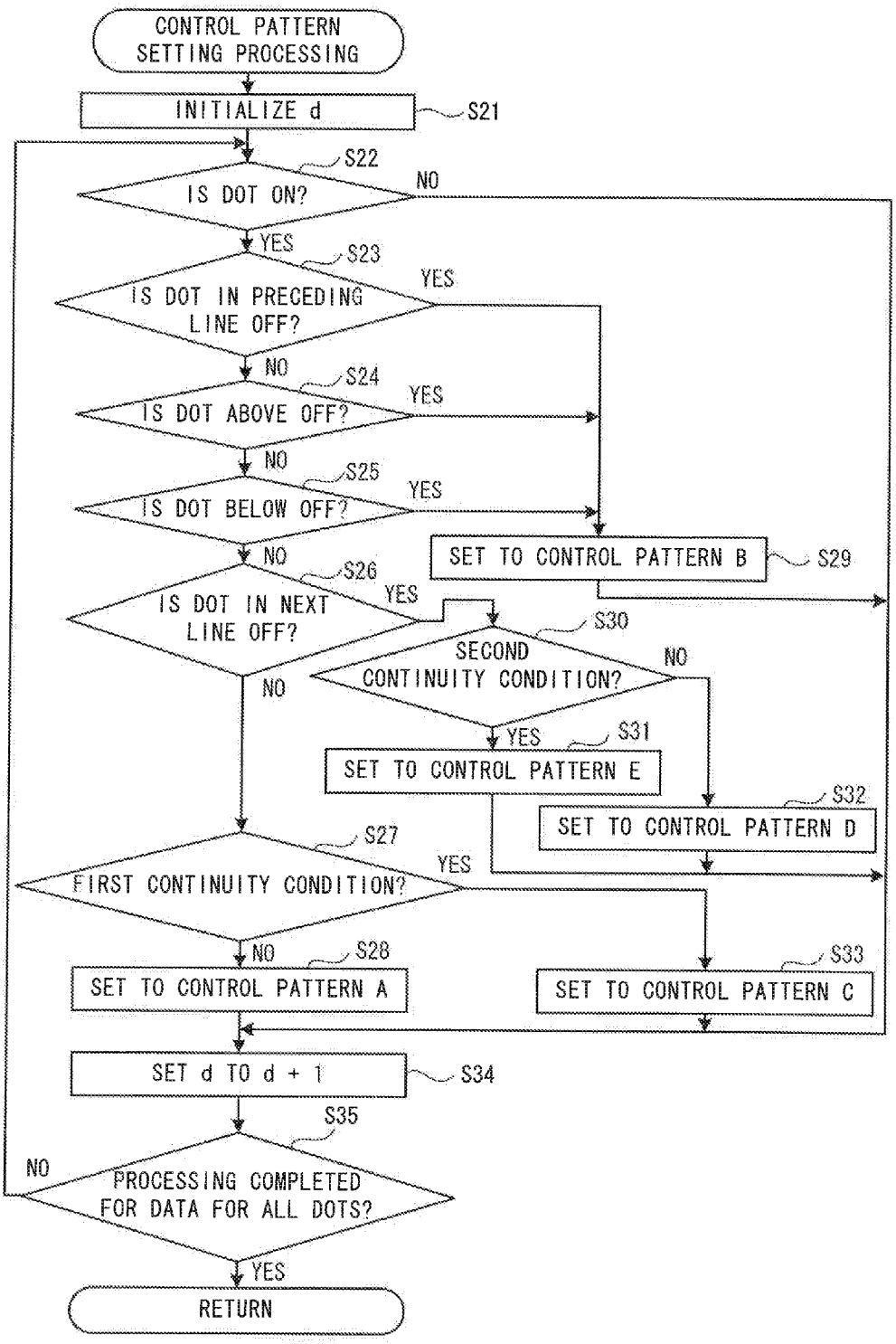
FIG. 15 is a flowchart of control pattern setting processing.

The control pattern setting processing will be explained with reference to the flowchart in FIG. 15. The control pattern setting processing is processing that creates work data for the control pattern A to the control pattern E. In a case where the line that is the target of printing includes a print dot, work data for at least one of the control pattern A to the control pattern E are created. First, the CPU 91 initializes d, which is a parameter, to be one (Step S21). d is a parameter that indicates the rank in each individual line. The CPU 91 stores d in the RAM 94. At this time, the CPU 91 sets to off the data for all of the dots in the work data for the control pattern A to the control pattern E.

The CPU 91 extracts, from the data that were acquired at Step S7, data for printing the individual dots, one dot at a time, starting from the rank d of the line that is the target of printing. For each individual dot, the CPU 91 determines whether the dot is ON (Step S22). In a case where the dot that is indicated by the extracted data is ON (YES at Step S22), the CPU 91 acquires dot information for the dots that surround the print dot that is indicated by the extracted data. The CPU 91 determines whether the dot in the rank d of the preceding line is OFF (Step S23). In a case where the dot in the rank d of the preceding line is OFF (YES at Step S23), the CPU 91 sets the current application control pattern for the dot that is the target object of the processing to the control pattern B (Step S29). Hereinafter, the dot that is the current target of the processing is referred to as the target dot.

In a case where the dot in the rank d of the preceding line is ON (NO at Step S23), the CPU 91 determines whether the dot above is OFF (Step S24). In a case where the CPU 91 determines that the dot above is OFF (YES at Step S24), the CPU 91 sets the current application control pattern for the target dot to the control pattern B (Step S29). In a case where the CPU 91 determines that the dot above is ON (NO at Step S24), the CPU 91 determines whether the dot below is OFF (Step S25). In a case where the CPU 91 determines that the dot below is OFF (YES at Step S25), the CPU 91 sets the current application control pattern for the target dot to the control pattern B (Step S29). In the processing at Step S29, the CPU 91 sets to ON a control pattern B flag that is stored in the RAM 94, for example.

In a case where, for example, the CPU 91 has determined that the dot in the rank d of the preceding line, the dot above, and the dot below are all ON (NO at Step S23; NO at Step S24; NO at Step S25), the CPU 91 determines whether the dot in the rank d of the next line is OFF (Step S26). In a case where the CPU 91 determines that the dot in the rank d of the next line is ON (NO at Step S26), the CPU 91 determines whether a first continuity condition is applicable to the target dot (Step S27). The first continuity condition is a condition that, for example, not less than a number x of ON dots (for example, five ON dots) occur in succession in the rank d up to the preceding line. In a case where the CPU 91 determines that the first continuity condition is not applicable to the target dot (NO at Step S27), the CPU 91 sets the current application control pattern for the target dot to the control pattern A. Then the CPU 91 sets the target dot to ON in the work data for the control pattern A (Step S28). The CPU 91 sets to ON a control pattern A flag that is stored in the RAM 94, for example. In a case where the CPU 91 determines that the first continuity condition is applicable to the target dot (YES at Step S27), the CPU 91 sets the current application control pattern for the target dot to the control pattern C. Then the CPU 91 sets the target dot to ON in the work data for the control pattern C (Step S33). The CPU 91 sets to ON a control pattern C flag that is stored in the RAM 94, for example.

In a case where, for example, the CPU 91 has determined that the dot in the rank d of the preceding line, the dot above, and the dot below are all ON (NO at Step S23; NO at Step S24; NO at Step S25), and that the dot in the rank d of the next line is OFF (YES at Step S26), the CPU 91 determines whether a second continuity condition is applicable to the target dot (Step S30). The second continuity condition is a condition that, for example, not less than a number y of OFF dots (for example, three OFF dots) occur in succession in the rank d from the next line onward. In a case where the CPU 91 determines that the second continuity condition is not applicable to the target dot (NO at Step S30), the CPU 91 sets the current application control pattern for the target dot to the control pattern D. Then the CPU 91 sets the target dot to ON in the work data for the control pattern D (Step S32). The CPU 91 sets to ON a control pattern D flag that is stored in the RAM 94, for example. In a case where the CPU 91 determines that the second continuity condition is applicable to the target dot (YES at Step S30), the CPU 91 sets the current application control pattern for the target dot to the control pattern E. Then the CPU 91 sets the target dot to ON in the work data for the control pattern E (Step S31). The CPU 91 sets to ON a control pattern E flag that is stored in the RAM 94, for example.

After setting the current application control pattern, the CPU 91 adds 1 to d (Step S34). In a case where the dot that is indicated by the extracted data is OFF (NO Step S22), the CPU 91 simply adds 1 to d (Step S34). Based on the value of d, the CPU 91 determines whether the processing has been completed for the data for all of the dots (Step S35). Specifically, in a case where one line has 128 dots, for example, the CPU 91 determines whether d is not less than 128. The thermal head 10 may include 128 heating elements, for example, and the print dot pattern in the image data may also contain 128 dots in a single line. In a case where the width of the image to be printed based on the image data is narrower than the width of the thermal head 10, the CPU 91 determines whether d is not less than a value that is equivalent to the width of the image. For example, in a case where the print dot pattern in the image data contains 100 dots in a single line, the CPU 91 determines whether d is not less than 100. In a case where an image with a narrower width than the width of the thermal head 10 is printed, there is to be heating elements that are not used in the printing. The heating elements that are not used in the printing may be seen as corresponding to the unprinted dots. In a case where the CPU 91 determines that the processing has not been completed for the data for all of the dots (NO at Step S35), the CPU 91 returns to the processing at Step S22. Then the CPU 91 repeats the processing for the data for all of the dots that correspond to the current rank. In a case where the CPU 91 determines that the processing has been completed for the data for all of the dots (YES at Step S35), the CPU 91 has completed the work data for the control pattern A to the control pattern E. Therefore, the CPU 91 terminates the control pattern setting processing and advances to the processing at Step S12 in FIG. 14.

Figure 14:
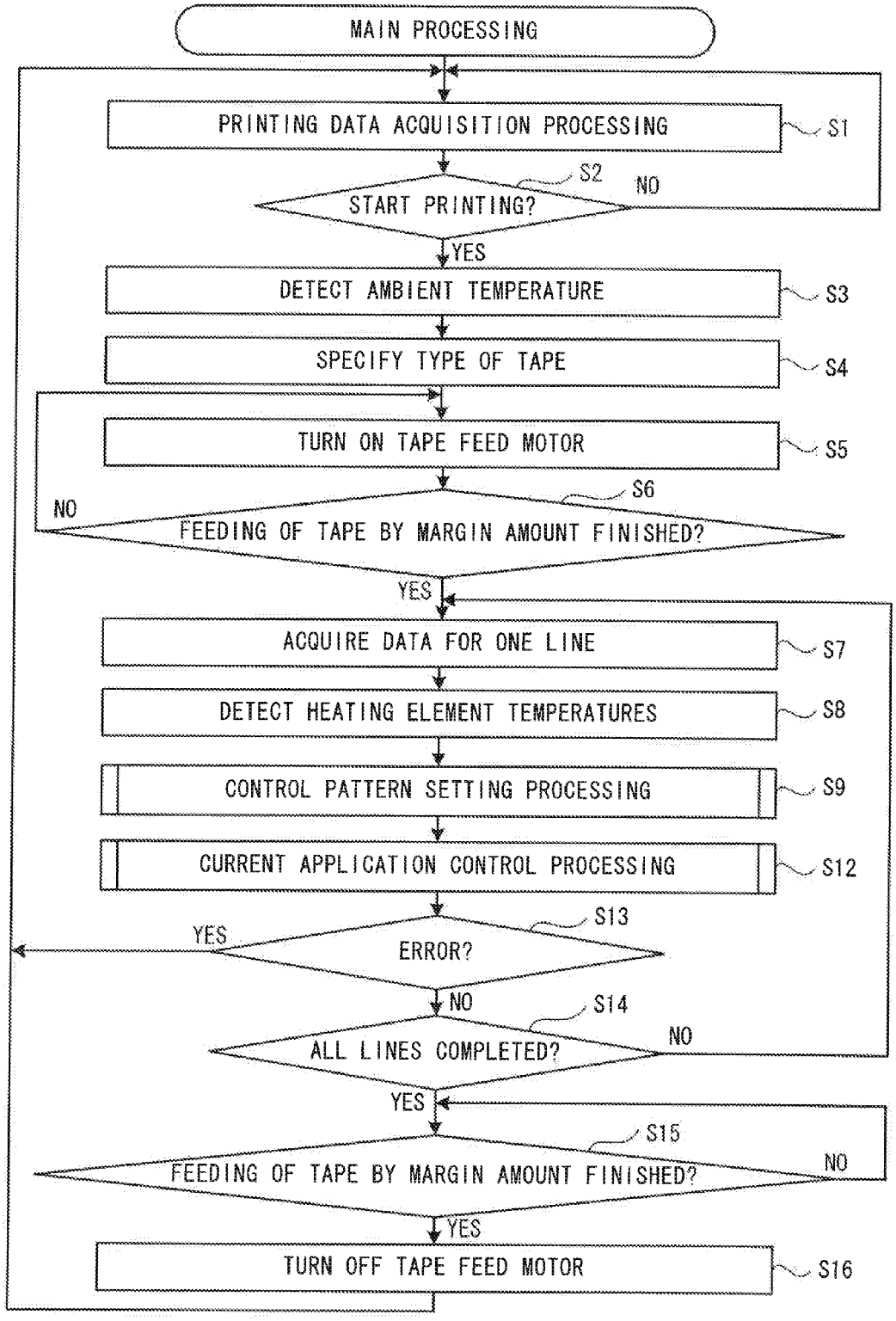
FIG. 14 is a flowchart of main processing.

As shown in FIG. 14, the CPU 91 performs current application control processing (Step S12). The current application control processing is astable current application control.

The current application control processing will be explained with reference to the flowchart in FIG. 16. First, the CPU 91 initializes the time parameter n that is stored in the time parameter storage area 942 of the RAM 94 to be zero (Step S41). A detailed explanation will not be provided, but in the present embodiment, in a state in which a strobe is held at Low active, the thermal head 10 is controlled only by the data and a latch. The CPU 91 sets each of a series of control constants to the first constant (Step S43). The control constants include a control pattern A control constant, a control pattern B control constant, a control pattern C control constant, a control pattern D control constant, and a control pattern E control constant, which are stored in the RAM 94, for example. The control constants are utilized in the control pattern A to the control pattern E when the timing at which the heating element 71 is turned OFF is calculated, for example. In a case where the type of tape is specified as the tape A in the processing at Step S4 in FIG. 14, for example, the CPU 91 references the basic constant table 9511 (refer to FIG. 11) that corresponds to the tape A. The CPU 91 sets the respective control constants to the first constants that correspond to the control pattern A to the control pattern E that were set by the control pattern setting processing (refer to FIG. 15). For example, the control pattern A control constant is set to 27700. The control pattern B control constant is set to 36993. The control pattern C control constant is set to 18467. The control pattern D control constant is set to 18467. The control pattern E control constant is set to 18467.

The CPU 91 sets the respective control flags to 1 in the control pattern A to control pattern E flag storage areas 943 to 947 in the RAM 94 (Step S44). As explained above, 1 is the control flag setting that indicates that the current application control is being performed for the first part of the printing cycle. Next, the CPU 91 sets, as transmission data, the work data for the control pattern A to the control pattern E for one line that were created by the control pattern setting processing (Step S9) that was explained above (Step S45). The data for the one line that were acquired at Step S9 are the work data for the control pattern A to the control pattern E. The CPU 91 transmits the transmission data to the thermal head 10 (Step S47). The heating elements 71 that correspond to the parts, within the transmission data for the one line, where the value is 1 generate heat, and the heating elements 71 that correspond to the parts, within the transmission data for the one line, where the value is zero do not generate heat.

Next, the CPU 91 performs control pattern A data update processing (Step S48). The control pattern A data update processing is processing that, by updating as necessary the transmission data that are transmitted to the thermal head 10, switches the application of the electric current on and off for the print dots that is to be printed using the control pattern A. The CPU 91 then performs control pattern B data update processing (Step S49). The CPU 91 then performs control pattern C data update processing (Step S50). The CPU 91 then performs control pattern D data update processing (Step S51). The CPU 91 then performs control pattern E data update processing (Step S52). In the same manner as the control pattern A data update processing, the data update processing for the control pattern B to the control pattern E is processing that, by updating as necessary the transmission data that are transmitted to the thermal head 10, switches the application of the electric current on and off for the print dots that is to be printed using the control pattern B to the control pattern E, respectively. The data update processing for the control pattern A to the control pattern E (Steps S48 to S52) will be explained.

Figure 17:
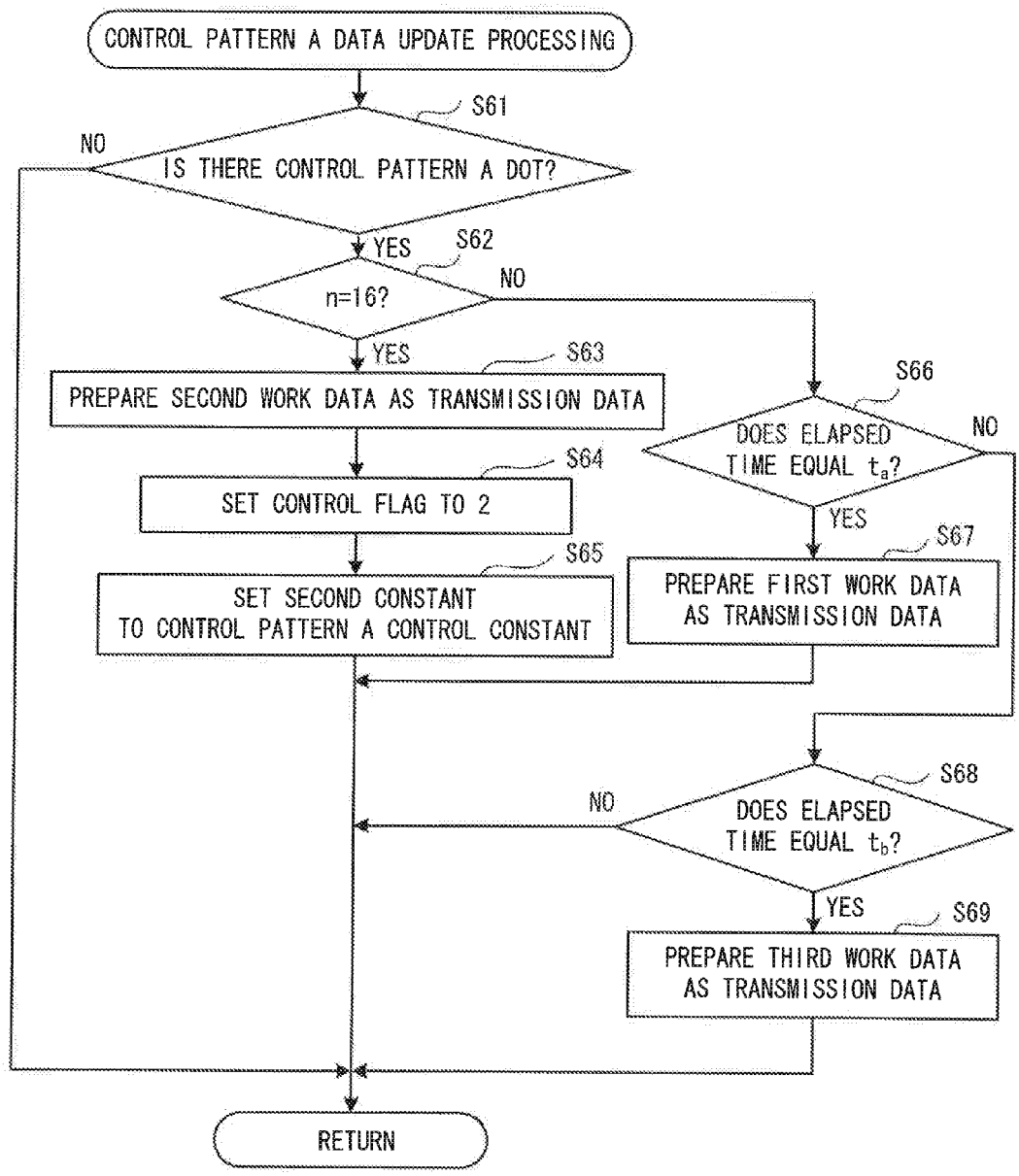
FIG. 17 is a flowchart of control pattern A data update processing.

The control pattern A data update processing will be explained with reference to FIG. 17. First, the CPU 91 determines whether there is a control pattern A dot (Step S61). The control pattern A dot is a dot that is to be printed using the control pattern A. In a case where the CPU 91 determines that there is a control pattern A dot (YES at Step S61), the CPU 91 determines whether the value of the time parameter n that is stored in the time parameter storage area 942 of the RAM 94 is 16 (Step S62). In control constant update processing (Step S55) that will be described below, the value of n is incremented by one each time 250 microseconds elapse. Therefore, n is updated whenever 250 microseconds elapse.

In a case where the CPU 91 determines that the value of n is not 16 (NO at Step S62), the CPU 91 determines whether the time that has elapsed since the transmission data were transmitted to the thermal head 10 is $t_a$ (Step S66). As explained above, $t_a$ is the time of the maximum temperature for the first peak in the temperature curve for the control pattern A. Accordingly, it is desirable to turn off the electric current at $t_a$ in order to prevent an excess of the applied energy. The determination as to whether the elapsed time is $t_a$ can be made by determining, for example, whether the control flag in the control pattern A flag storage area 943 of the RAM 94 has been set to 1 and whether the control pattern A control constant has become not greater than zero. If the current application control has been performed for the first part of the printing cycle, and if the control pattern A control constant is not greater than zero, it can be inferred that the heating element 71 has reached its maximum temperature under the application of sufficient voltage. In this case, it can be determined that the elapsed time is $t_a$.

In a case where the CPU 91 determines the elapsed time is not $t_a$ (NO at Step S66), the CPU 91 then determines whether the elapsed time is $t_b$ (Step S68). In a case where the CPU 91 determines the elapsed time is not $t_b$ (NO at Step S68), the CPU 91 terminates the control pattern A data update processing and proceeds to the processing at Step S49 in FIG. 16.

On the other hand, in a case where the CPU 91 determines the elapsed time is $t_a$ (YES at Step S66), the CPU 91 prepares first work data as the transmission data (Step S67). The first work data are data that set the application of the electric current to OFF only for the heating element 71 that corresponds to the control pattern A dot and that leave the current application ON/OFF settings unchanged for the heating elements 71 that correspond to the other dots. For example, all of the data that correspond to the control pattern A dots may be set to zero. The data are transmitted to the thermal head 10 at Step S54 in FIG. 16, which will be described below. The CPU 91 terminates the control pattern A data update processing and proceeds to the processing at Step S49 in FIG. 16.

Figure 5:
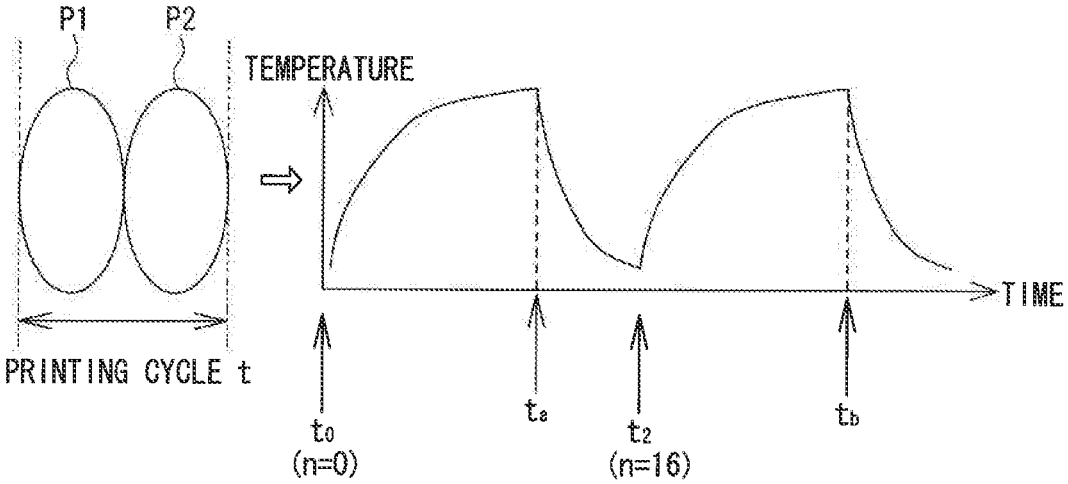
FIG. 5 is a figure that shows a representation of heating pulses and a temperature curve for a control pattern A.

In a case where the CPU 91 determines that the value of n that is stored in the time parameter storage area 942 of the RAM 94 is 16 (YES at Step S62), the elapsed time is equivalent to the $t_2$ that is shown in FIG. 5. The CPU 91 prepares second work data as the transmission data (Step S63). The second work data are data that set the application of the electric current to ON only for the heating element 71 that corresponds to the control pattern A dot and that leave the current application ON/OFF settings unchanged for the heating elements 71 that correspond to the other dots.

The CPU 91 sets the control flag to 2 in the control pattern A flag storage area 943 in the RAM 94 (Step S64). 2 is the control flag setting that indicates that the current application control is being performed for the second part of the printing cycle. Next, the CPU 91 sets the second constant to the control pattern A control constant (Step S65). The CPU 91 references the basic constant table 9511 (refer to FIG. 11) that corresponds to the tape A and sets the second constant for the control pattern A to 27700, for example. The CPU 91 terminates the control pattern A data update processing and proceeds to the processing at Step S49 in FIG. 16. In the processing at Step S61, in a case where the CPU 91 determines that there are not any the control pattern A dots (NO at Step S61), the CPU 91 terminates the control pattern A data update processing without doing anything and proceeds to the processing at Step S49 in FIG. 16.

The CPU 91 performs the same sort of processing for the current application control in the second part of the printing cycle as the CPU 91 performed for the current application control in the first part of the printing cycle that was described above. In the current application control for the second part of the printing cycle, the CPU 91 determines whether the elapsed time is $t_b$ (Step S68). As shown in FIG. 5, $t_b$ is the time of the maximum temperature for the second peak in the temperature curve for the control pattern A. Accordingly, it is desirable to turn off the electric current at $t_b$ in order to prevent an excess of the applied energy. The determination as to whether the elapsed time is $t_b$ can be made by determining, for example, whether the control flag in the control pattern A flag storage area 943 of the RAM 94 has been set to 2 and whether the control pattern A control constant has become not greater than zero. If the current application control has been performed for the second part of the printing cycle, and if the control pattern A control constant is not greater than zero, it can be inferred that the heating element 71 has reached its maximum temperature under the application of sufficient voltage. In this case, it can be determined that the elapsed time is $t_b$.

In a case where the CPU 91 determines the elapsed time is $t_b$ (YES at Step S68), the CPU 91 prepares third work data as the transmission data (Step S69). The third work data are data that set the application of the electric current to OFF only for the heating element 71 that corresponds to the control pattern A dot and that leave the current application ON/OFF settings unchanged for the heating elements 71 that correspond to the other dots. The CPU 91 terminates the control pattern A data update processing and proceeds to the processing at Step S49 in FIG. 16.

Figure 16:
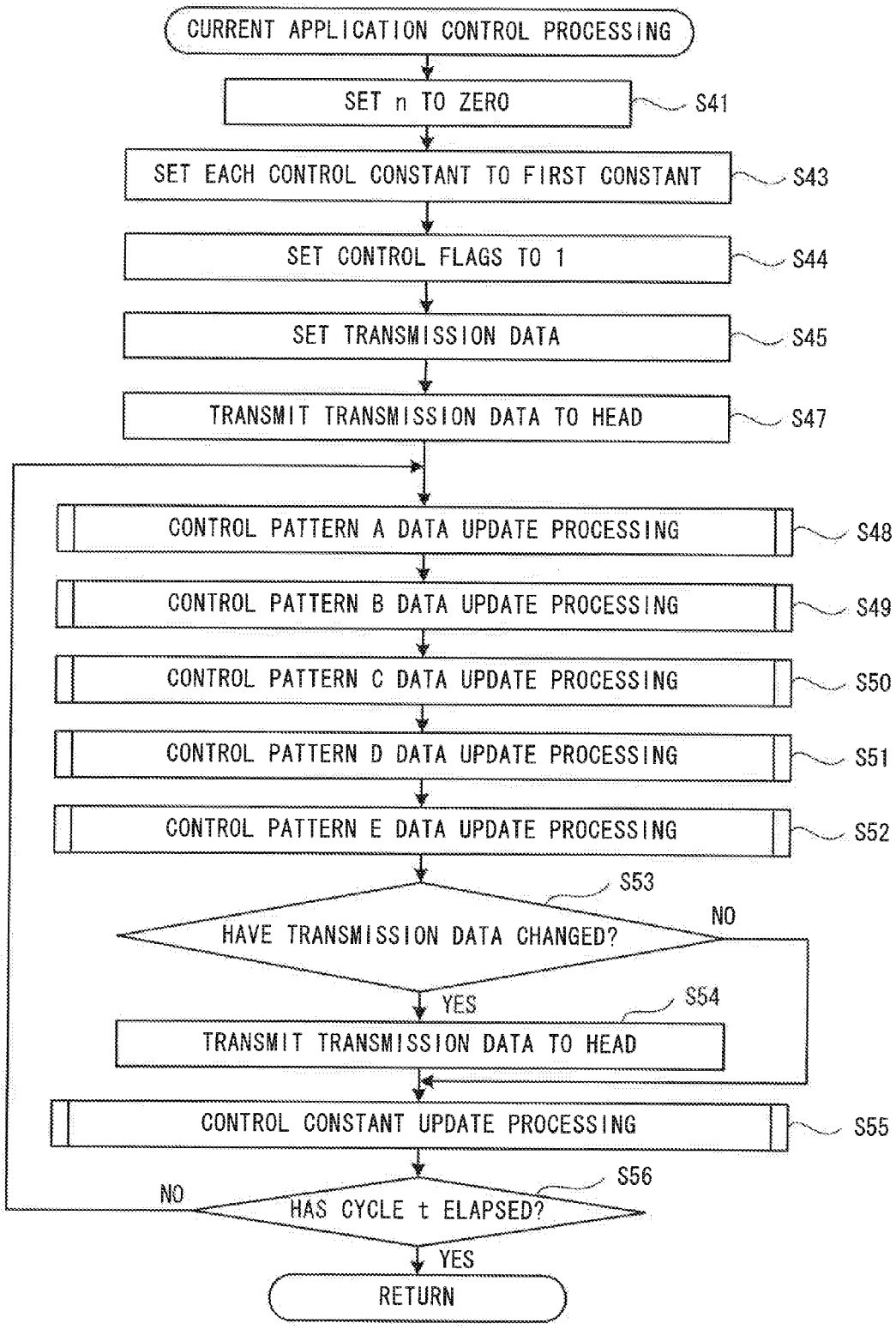
FIG. 16 is a flowchart of current application control processing.

As shown in FIG. 16, the CPU 91 performs the control pattern B data update processing to the control pattern D data update processing in that order (Steps S49 to S51). The control pattern B data update processing to the control pattern D data update processing are the similar processing as the control pattern A data update processing that is described above, so will be explained briefly with reference to the flowchart in FIG. 17.

Figure 6:
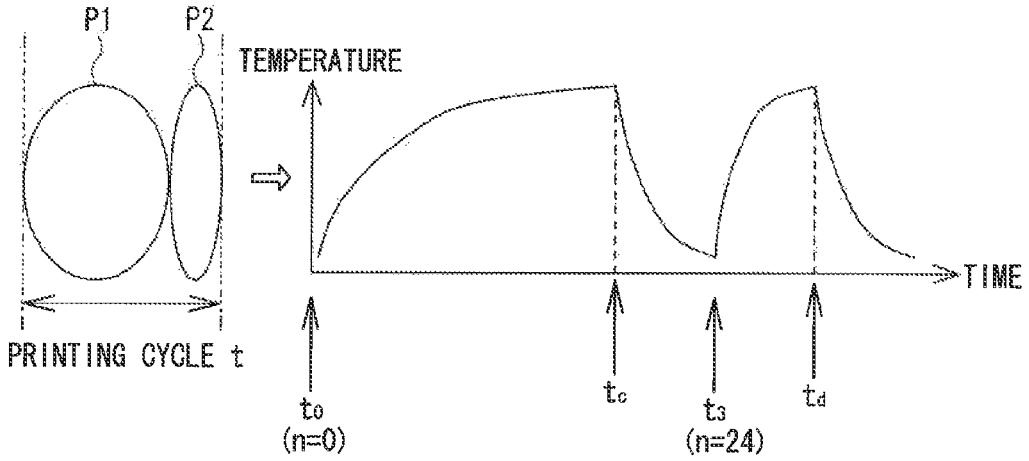
FIG. 6 is a figure that shows a representation of heating pulses and a temperature curve for a control pattern B.

In the control pattern B data update processing (Step S49), at Step S62, the CPU 91 determines whether the value of the time parameter n that is stored in the time parameter storage area 942 of the RAM 94 is 24 (refer to FIG. 6). At Step S66, the CPU 91 determines whether the time that has elapsed since the transmission data were transmitted to the thermal head 10 is $t_c$. At Step S68, the CPU 91 determines whether the elapsed time is $t_d$. The various types of the data that are used in the processing at the other steps need only to be data that pertain to the control pattern B.

Figure 7:
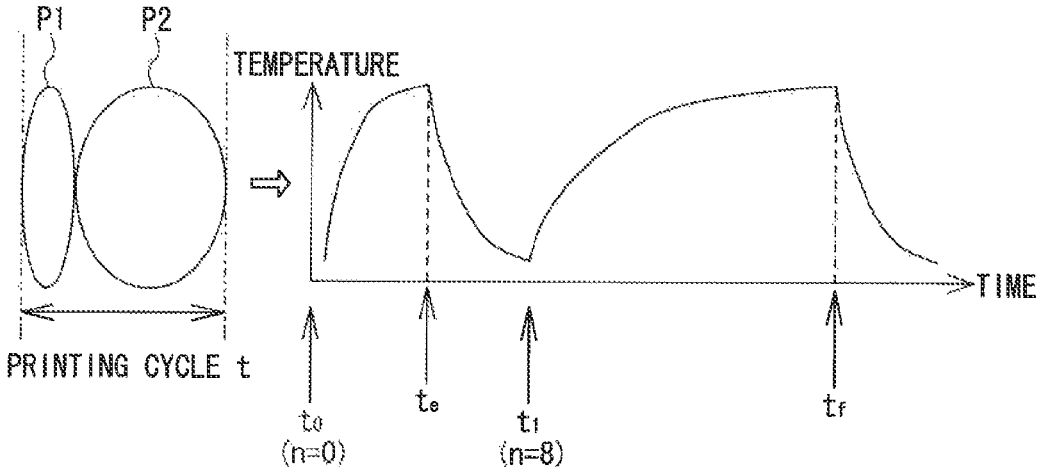
FIG. 7 is a figure that shows a representation of heating pulses and a temperature curve for a control pattern C.

In the control pattern C data update processing (Step S50), at Step S62, the CPU 91 determines whether the value of the time parameter n that is stored in the time parameter storage area 942 is 8 (refer to FIG. 7). At Step S66, the CPU 91 determines whether the time that has elapsed since the transmission data were transmitted to the thermal head 10 is $t_e$. At Step S68, the CPU 91 determines whether the elapsed time is $t_f$. The various types of the data that are used in the processing at the other steps need only to be data that pertain to the control pattern C.

Figure 8:
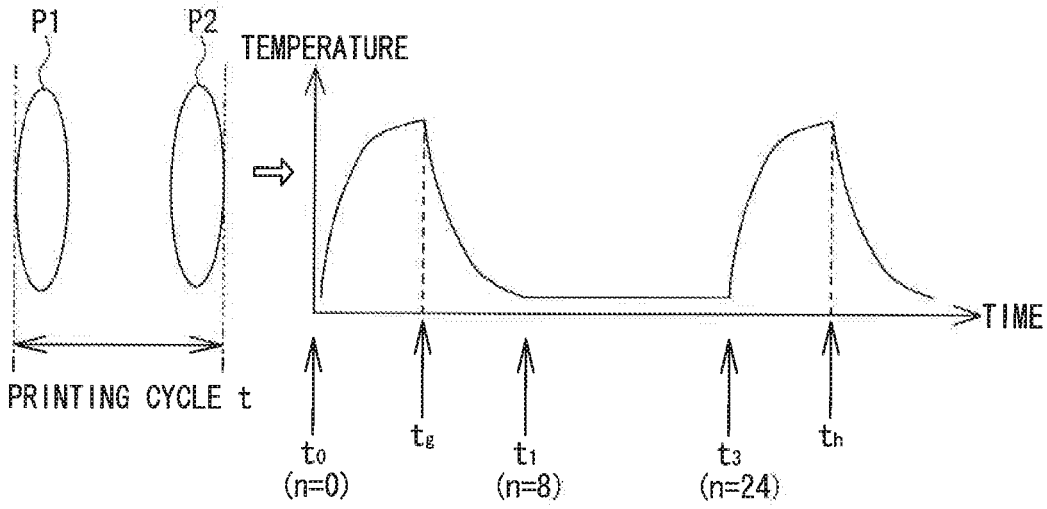
FIG. 8 is a figure that shows a representation of heating pulses and a temperature curve for a control pattern D.

In the control pattern D data update processing (Step S51), at Step S62, the CPU 91 determines whether or not the value of the time parameter n that is stored in the time parameter storage area 942 is 24 (refer to FIG. 8). At Step S66, the CPU 91 determines whether the time that has elapsed since the transmission data were transmitted to the thermal head 10 is $t_g$. At Step S68, the CPU 91 determines whether the elapsed time is $t_h$. The various types of the data that are used in the processing at the other steps need only to be data that pertain to the control pattern D.

Figure 18:
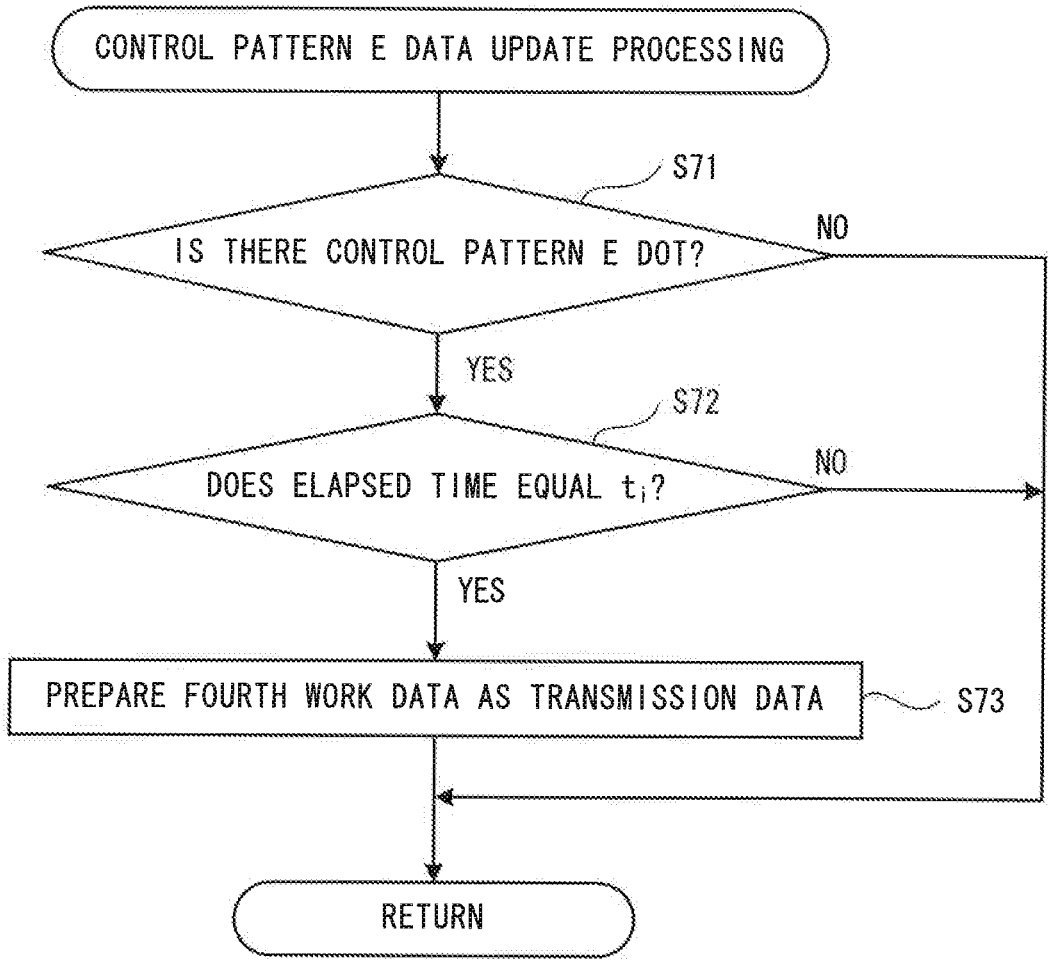
FIG. 18 is a flowchart of control pattern E data update processing.

As shown in FIG. 16, after the control pattern D data update processing (Step S51), the CPU 91 performs the control pattern E data update processing (Step S52). The control pattern E data update processing will be explained with reference to the flowchart in FIG. 18. First, the CPU 91 determines whether there is a control pattern E dot (Step S71). The control pattern E dot is a dot that is to be printed using the control pattern E. In a case where the CPU 91 determines that there are not any control pattern E dots (NO at Step S71), the CPU 91 terminates the control pattern E data update processing at that point and proceeds to the processing at Step S53 in FIG. 16, which will be described below.

In a case where the CPU 91 determines that there is a control pattern E dot (YES at Step S71), the CPU 91 determines whether the elapsed time is $t_i$ (Step S72). As explained above, $t_i$ is the time of the maximum temperature in the temperature curve for the control pattern E. Accordingly, it is desirable to turn off the electric current at $t_i$ in order to prevent an excess of the applied energy. The determination as to whether the elapsed time is $t_i$ can be made by determining, for example, whether the control pattern E control constant has become not greater than zero. If the control pattern E control constant is not greater than zero, it can be inferred that the heating element 71 has reached its maximum temperature under the application of sufficient voltage. In this case, it can be determined that the elapsed time is $t_i$.

In a case where the CPU 91 determines the elapsed time is not $t_i$ (NO at Step S72), the CPU 91 terminates the control pattern E data update processing and proceeds to the processing at Step S53 in FIG. 16. In a case where the CPU 91 determines the elapsed time is $t_i$ (YES at Step S72), the CPU 91 prepares fourth work data as the transmission data (Step S73). The fourth work data are data that set the application of the electric current to OFF only for the heating element 71 that corresponds to the control pattern E dot and that leave the current application ON/OFF settings unchanged for the heating elements 71 that correspond to the other dots. The CPU 91 terminates the control pattern E data update processing and proceeds to the processing at Step S53 in FIG. 16.

As shown in FIG. 16, after the control pattern E data update processing (Step S52), the CPU 91 determines whether there has been a change in the transmission data (Step S53). Here, the CPU 91 may store, in the RAM 94 or the like, for example, the transmission data that were transmitted to the thermal head 10 in the preceding round of processing and may determine whether there has been a change in the transmission data by comparing the transmission data after the data update processing to the transmission data from the preceding round of processing. In a case where the CPU 91 determines that there has been a change in the transmission data (YES at Step S53), the CPU 91 transmits the updated transmission data to the thermal head 10 (Step S54). The data that are transmitted to the thermal head 10 replace the data that were in the thermal head 10 before the transmission. The updated transmission data are the work data for the control pattern A to the control pattern E that were prepared at Steps S48 to S52.

For example, if the transmission data are the first work data that were prepared at Step S67 in the control pattern A data update processing, the heating element 71 that corresponds to the control pattern A dot is not heated. Therefore, an excess of the applied energy can be prevented. If the transmission data are the second work data that were prepared at Step S63, the application of the electric current to the heating element 71 that corresponds to the control pattern A dot is set to ON, while the current application ON/OFF settings are left unchanged for the heating elements 71 that correspond to the dots other than the control pattern A dot. Therefore, the heating element 71 that corresponds to the control pattern A dot generates heat. If the transmission data are the third work data that were prepared at Step S69, the application of the electric current to the heating element 71 that corresponds to the control pattern A dot is set to OFF, while the settings are left unchanged for the dots other than the control pattern A dot. Accordingly, the heating element 71 that corresponds to the control pattern A dot is not heated. Therefore, an excess of the applied energy can be prevented. The cases in which the work data for the control pattern B to the control pattern E are transmitted are processed in the similar manner.

The CPU 91 performs the control constant update processing (Step S55). In a case where there has not been a change in the transmission data (NO at Step S53), the CPU 91 performs the control constant update processing (Step S55) without transmitting the transmission data.

Figure 19:
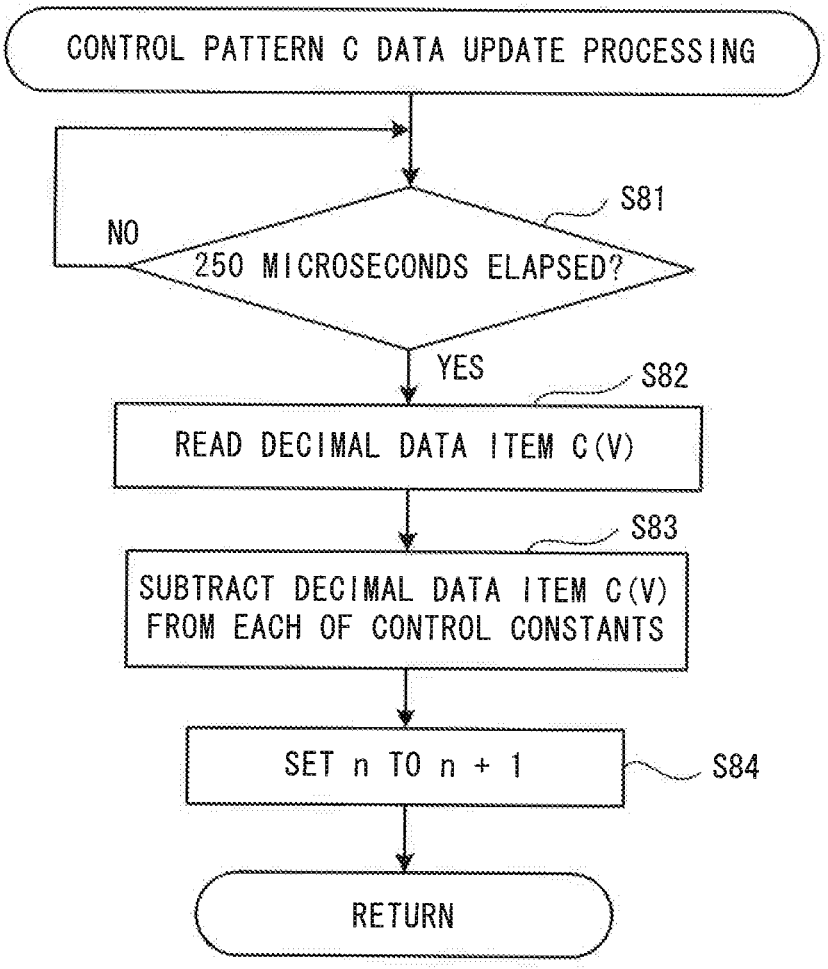
FIG. 19 is a flowchart of control constant update processing.

The control constant update processing will be explained with reference to the flowchart in FIG. 19. First, the CPU 91 determines whether 250 microseconds have elapsed since the transmission data were transmitted to the thermal head 10 at Step S54 in FIG. 16 (Step S81). In a case where the CPU 91 determines that 250 microseconds have not elapsed (NO at Step S81), the CPU 91 returns to the processing at Step S81 and waits. In a case where the CPU 91 determines that 250 microseconds have elapsed (YES at Step S81), the CPU 91 reads C(V), which is a decimal data item (Step S82). For example, the CPU 91 reads the voltage that is currently being applied to the heating element 71 and references the decimal data table 9521 (refer to FIG. 12) that corresponds to the tape A. In a case where the voltage that is read is 5.11, for example, the decimal data item C(V) is 1241. The CPU 91 subtracts the decimal data item C(V) from each of the control constants that are stored in the RAM 94 (Step S83). The control pattern A control constant, for example, is initially set to 27700, which corresponds to the second constant for the control pattern A. Accordingly, when 1241 is subtracted from 27700, the control pattern A control constant becomes 26459. The same sort of computation is performed for the control pattern B control constant, the control pattern C control constant, the control pattern D control constant, and the control pattern E control constant.

As explained above, as the voltage becomes higher, the time until each of the control constants becomes not greater than zero becomes shorter. That is, the higher the voltage becomes, the shorter the application duration for the heating pulse becomes. Therefore, an excess of the applied energy can be prevented. Conversely, as the voltage becomes lower, the time until each of the control constants becomes not greater than zero becomes longer. That is, the lower the voltage becomes, the longer the application duration for the heating pulse becomes. It is therefore possible to compensate for a shortfall in the applied energy. The CPU 91 adds one to the time parameter n that is stored in the time parameter storage area 942 of the RAM 94 (Step S84). The CPU 91 terminates the control constant update processing and returns to the processing at Step S56 in FIG. 16.

As shown in FIG. 16, the CPU 91 determines whether the printing cycle t has elapsed (Step S56). In a case where the printing cycle t has not yet elapsed (NO at Step S56), the CPU 91 returns to the processing at Step S48. Then the CPU 91 continues to repeat the processing at Steps S48 to S56 until the printing cycle t elapses. In a case where the CPU 91 determines that the printing cycle t has elapsed (Step S56), the processing of one line has been finished, so the CPU 91 terminates the current application control processing for the one line. The CPU 91 proceeds to the processing at Step S13 in FIG. 14. The determination as to whether the printing cycle t has elapsed is made by determining whether the time parameter n has reached a specified value.

At Step S13 in FIG. 14, the CPU 91 determines whether an error has occurred. In a case where an error has occurred (YES at Step S13), the CPU 91 returns to Step S1 and performs the processing over again from the beginning. In a case where an error has not occurred (NO at Step S13), the CPU 91 determines whether the processing has been completed for all of the lines (Step S14). In a case where the processing has not been completed for all of the lines (NO at Step S14), the CPU 91 returns to Step S7 and repeats the processing that has been described above (Steps S7 to S13) in the same manner for the next line.

In a case where the CPU 91 determines that the processing has been completed for all of the lines (YES at Step S14), the CPU 91 determines whether the feeding of the tape 70 by a margin amount has been finished (Step S15). In a case where the CPU 91 determines that the feeding of the tape 70 by a margin amount has not been finished (NO at Step S15), the CPU 91 returns to Step S15 and waits while the tape feed motor 15 operates. In a case where the CPU 91 determines that the feeding of the tape 70 by a margin amount has been finished (YES at Step S15), the CPU 91 turns off the operation of the tape feed motor 15 (Step S16). Then the CPU 91 returns to Step S1 and repeats the processing. The CPU 91 performs the main processing repeatedly until the power supply is turned off.

As explained above, in the present embodiment, the tape printer 1 includes the thermal head 10. The thermal head 10 includes the plurality of the heating elements 71. The plurality of the heating elements 71 are arrayed at a specified pitch in the main scanning direction. Each of the heating elements 71 has a rectangular shape in a plan view. The length of each of the heating elements 71 in the sub-scanning direction is shorter than the length of each of the heating elements 71 in the main scanning direction. The heat generation efficiency of the heating element 71 can therefore be improved. The electric power that is consumed can be conserved accordingly. It is unnecessary to raise the temperature of the heating elements 71 above what is required. Problems such as sticking and the like, for example, can therefore be prevented.

In the embodiment that is described above, with the control patterns A to D, printing is performed by applying at least two heating pulses for the printing of a single dot within the printing cycle t. The two heating pulses may be the heating pulse P1 and the heating pulse P2, for example. The print density in the auxiliary scanning direction can therefore be increased, so high-density printing is possible. The magnitudes of the heating pulses P1, P2 and the ratio of the magnitudes of the heating pulses P1, P2 may be varied according to data on the area around the printed dot, for example. Electric power can therefore be consumed appropriately, and better energy efficiency can be achieved.

The present disclosure is not limited to the embodiment that is described above, and various types of modifications may be made. For example, in the embodiment that is described above, in the control pattern E, only the heating pulse P1 for the first part of the printing cycle is applied, and the heating pulse P2 for the second part of the printing cycle is not applied. It is acceptable to apply only the heating pulse P2 for the second part, without applying the heating pulse P1 for the first part. In the embodiment that is described above, the current application control patterns include the control pattern A to the control pattern E, but it is acceptable to include only the control pattern A to the control pattern D and to omit the control pattern E. In that case, Step S30 in FIG. 15, where the CPU 91 determines whether the second continuity condition has been met, may be omitted. Then, in a case where, at Step S26, the CPU 91 has determined that the dot in the rank d of the next line is OFF (YES at Step S26), the CPU 91 may set the current application control pattern for the target dot to the control pattern D.

In the embodiment that is described above, one of one and two heating pulses are applied within the printing cycle t. However, more than two heating pulses may be applied within the printing cycle t.

In the embodiment that is described above, the printing speed is constant from the start of printing until the end of printing, such that the printing cycle is 8 milliseconds, for example. However, the printing cycle is not limited to 8 milliseconds, and the printing speed may be faster or slower. In a case where the printing speed is faster, for example, at Step S81 in the control constant update processing that is shown in FIG. 19, the CPU 91 may determine whether a time period that is shorter than 250 microseconds has elapsed.

The present disclosure can be applied in a case where the printing speed varies from the start of printing until the end of printing. For example, the present disclosure can be applied to printing control in which the printing speed is slow immediately after the printing starts, and then the printing speed is increased gradually, such that the printing speed is fast while the printing is in progress, and then the printing speed is gradually decreased shortly before the printing ends, until at the end, the printing speed is slow and the printing terminates. The present disclosure can be applied in a case where, during printing at a high printing speed, the printing speed is varied in accordance with the print density.

In the embodiment that is described above, the current application control pattern is set based on the information about the dots in the area around the print dot. The current application control pattern may be set by additionally taking into consideration the temperature of the heating element, for example. A modified example in which the temperature of the heating element is taken into consideration will be explained with reference to FIGS. 20 and 21. The modified example uses the same configuration, control patterns, and the like as in the embodiment that is described above, so the explanation will focus on the points that are different from the embodiment that is described above.

A temperature compensation table 9551 will be explained with reference to FIG. 20. The temperature compensation table 9551 may be stored in the flash memory 95 (refer to FIG. 10), for example. The temperature compensation table 9551 may store heating element temperatures, temperature A/D values, and compensation values, for example, in association with one another. In the modified example, the temperature A/D values and the compensation values are stored corresponding to the heating element temperatures in intervals of 5 degrees Celsius. However, the temperature A/D values and the compensation values may be stored corresponding to the heating element temperatures in intervals of 1 degree Celsius, for example. The compensation values that correspond to temperatures (7 degree Celsius, for example) that fall within the intervals between the heating element temperatures may be derived by calculation, for example. The temperature A/D values and/or the compensation values may be set such that the temperature A/D values and/or the compensation values have proportional relationships to the heating element temperatures.

Figure 21:
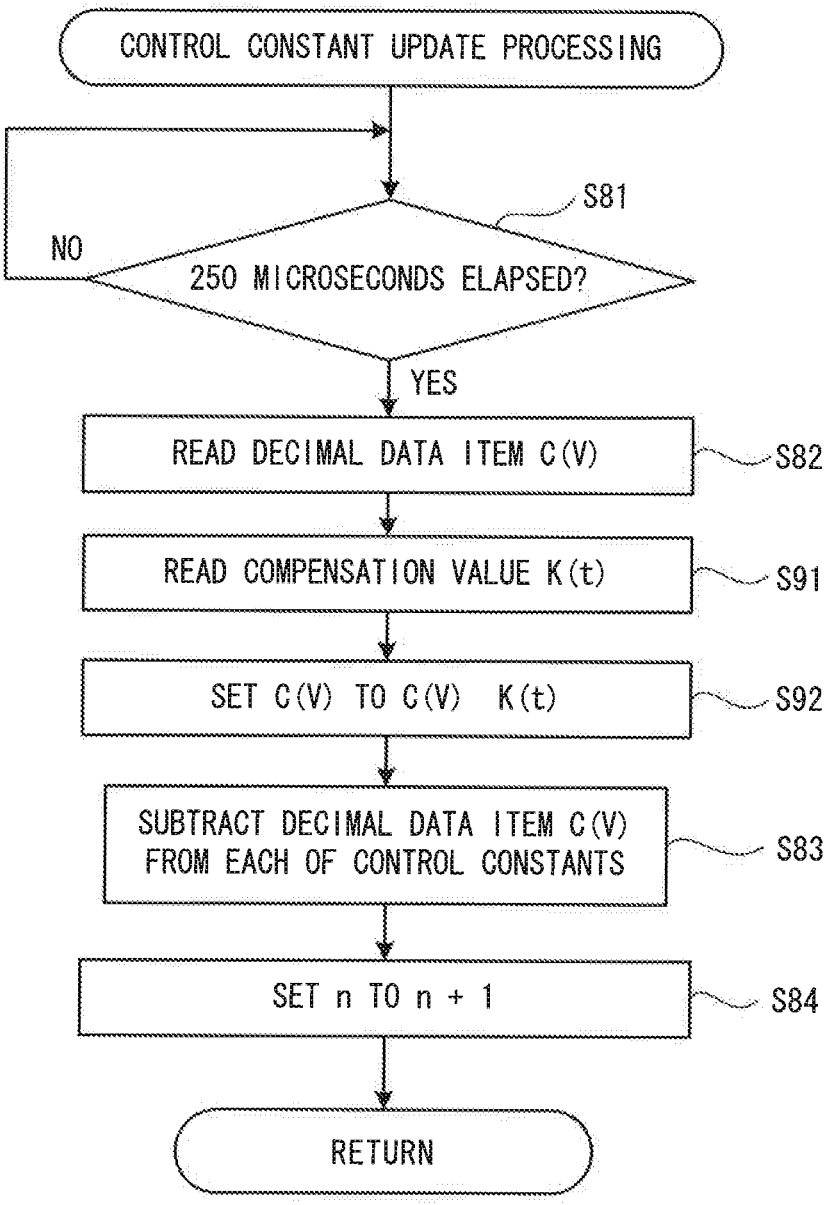
FIG. 21 is a flowchart of a modified example of control constant update processing.

The modified example of the control constant update processing will be explained with reference to the flowchart in FIG. 21. The content of the control constant update processing in the modified example differs only in part from the that of the control constant update processing in the embodiment that is described above (refer to FIG. 19). As described above, the CPU 91 detects the temperature of the heating element as a temperature A/D value and stores the temperature A/D value in the RAM 94 (Step S8 in FIG. 14). As shown in FIG. 21, the CPU 91 performs the control constant update processing by adding Steps S91 and S92 between Steps S82 and S83, for example.

After reading the decimal data item C(V) (Step S82), the CPU 91 reads K(t), which is a compensation value (Step S91). For example, in a case where the temperature A/D value is 173, the temperature compensation table 9551 shows that the temperature is 10 degrees Celsius and the compensation value K(t) is 0.910 corresponding to the temperature A/D value of 173. The CPU 91 multiplies the decimal data item C(V) by the compensation value K(t) (Step S92). The CPU 91 takes the decimal data item C(V) that has been multiplied by the compensation value K(t) and subtracts the decimal data item C(V) from each of the control constants (Step S83). In this manner, in the modified example, the current application control patterns can be set by taking the temperature of the heating element into consideration, in addition to the information about the dots in the area around the print dot. For example, if the temperature of the heating element is an extremely high temperature, the compensation value K(t) becomes greater, so the decimal data item C(V) also becomes greater. The times by which the individual control constants become not greater than zero therefore come sooner, and the application duration for the heating pulse becomes shorter. It therefore becomes possible to perform heating control that is in accordance with the heat accumulation circumstances in the area around the thermal head 10.

In the case of the modified example, if a tape printer is used that is not provided with the heating element temperature sensor 28, the ambient temperature sensor 27 may be used as a substitute. In that case, it would be sufficient as long as a temperature compensation table is available for setting the compensation value that corresponds to the temperature that is detected by the ambient temperature sensor 27.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer, comprising:

a feeding portion that is configured to feed a printing medium in a sub-scanning direction that is orthogonal to a main scanning direction;

a printing portion that includes a plurality of heating elements that are arrayed in the main scanning direction and that is configured to perform printing on the printing medium fed by the feeding portion when heating pulses are applied to the plurality of heating elements each corresponding to a single dot, a length of each of the plurality of heating elements in the sub-scanning direction being shorter than a length of each of the plurality of heating elements in the main scanning direction; and a processor that is configured to apply one or more heating pulses to one of the plurality of heating elements in response to a command to print one dot.

2. The printer according to claim 1, wherein the processor is configured to set a first pulse width and a second pulse width in response to the command to print the one dot, the first pulse width being a pulse width of a first heating pulse to be applied first, and the second pulse width being a pulse width of a second heating pulse to be applied after the first heating pulse has been applied, apply the first heating pulse with the first pulse width that has been set, and apply the second heating pulse with the second pulse width that has been set.

3. The printer according to claim 2, wherein the processor is configured to set a first time and a second time in response to the command to print the one dot, the first time being a time when the first heating pulse starts to be applied, and the second time being a time when the second heating pulse starts to be applied, apply the first heating pulse with the first pulse width at the first time that has been set, and apply the second heating pulse with the second pulse width at the second time that has been set.

4. The printer according to claim 2, wherein the processor is further configured to acquire printing data, and the processor is configured to set the first pulse width and the second pulse width, based on the printing data that have been acquired, in accordance with whether at least one dot that is adjacent to the one dot to be printed by the one of the plurality of heating elements is a print dot or an unprinted dot.

5. The printer according to claim 4, wherein the processor is configured to apply one of the first heating pulse and the second heating pulse, based on the printing data that have been acquired, in response to a command to print one dot that is a final dot among a plurality of dots that is to be printed consecutively on the printing medium in the sub-scanning direction.

6. The printer according to claim 4, further comprising:

a temperature detecting portion that is configured to detect a temperature in an area around the printing portion, wherein the processor is configured to set the first pulse width and the second pulse width based on the printing data that have been acquired and on the temperature that has been detected by the temperature detecting portion.

7. A non-transitory computer-readable medium storing a control program executable on a printer, the printer that includes:

a feeding portion that is configured to feed a printing medium in a sub-scanning direction that is orthogonal to a main scanning direction; and a printing portion that includes a plurality of heating elements that are arrayed in the main scanning direction and that is configured to perform printing on the printing medium fed by the feeding portion when heating pulses are applied to the plurality of heating elements each corresponding to a single dot, and the program comprising computer-readable instructions, when executed, to cause the printer to perform the step of applying one or more heating pulses to one of the plurality of heating elements in response to a command to print one dot, a length of each of the plurality of heating elements in the sub-scanning direction being shorter than a length of each of the plurality of heating elements in the main scanning direction.

8. The non-transitory computer-readable medium according to claim 7, wherein the applying one or more heating pulses includes:

setting a first pulse width and a second pulse width in response to the command to print the one dot, the first pulse width being a pulse width of a first heating pulse to be applied first, and the second pulse width being a pulse width of a second heating pulse to be applied after the first heating pulse has been applied;

applying the first heating pulse with the first pulse width that has been set; and applying the second heating pulse with the second pulse width that has been set.

9. The non-transitory computer-readable medium according to claim 8, wherein the applying one or more heating pulses further includes:

setting a first time and a second time in response to the command to print the one dot, the first time being a time when the first heating pulse starts to be applied, and the second time being a time when the second heating pulse starts to be applied;

applying the first heating pulse with the first pulse width at the first time that has been set; and applying the second heating pulse with the second pulse width at the second time that has been set.

10. The non-transitory computer-readable medium according to claim 8, wherein the program further comprising computer-readable instructions, when executed, to cause the printer to perform the step of acquiring printing data, the applying one or more heating pulses further includes:

setting the first pulse width and the second pulse width, based on the printing data that have been acquired, in accordance with whether at least one dot that is adjacent to the one dot to be printed by the one of the plurality of heating elements is a print dot or an unprinted dot.

11. The non-transitory computer-readable medium according to claim 10, wherein the applying one or more heating pulses further includes:

applying one of the first heating pulse and the second heating pulse, based on the printing data that have been acquired, in response to a command to print one dot that is a final dot among a plurality of dots that is to be printed consecutively on the printing medium in the sub-scanning direction.

12. The non-transitory computer-readable medium according to claim 10, wherein the program further comprising computer-readable instructions, when executed, to cause the printer to perform the step of acquire a temperature that has been detected by a temperature detecting portion of the printer, the temperature being a temperature in an area around the printing portion, and the applying one or more heating pulses further includes:

setting the first pulse width and the second pulse width based on the printing data that have been acquired and on the temperature that has been acquired.

13. A method that is executed by a printer, the printer that includes:

a feeding portion that is configured to feed a printing medium in a sub-scanning direction that is orthogonal to a main scanning direction; and a printing portion that includes a plurality of heating elements that are arrayed in the main scanning direction and that is configured to perform printing on the printing medium fed by the feeding portion when heating pulses are applied to the plurality of heating elements each corresponding to a single dot, and the method comprising the step of applying one or more heating pulses to one of the plurality of heating elements in response to a command to print one dot, a length of each of the plurality of heating elements in the sub-scanning direction being shorter than a length of each of the plurality of heating elements in the main scanning direction.

14. The method according to claim 13, wherein the applying one or more heating pulses includes:

setting a first pulse width and a second pulse width in response to the command to print the one dot, the first pulse width being a pulse width of a first heating pulse to be applied first, and the second pulse width being a pulse width of a second heating pulse to be applied after the first heating pulse has been applied;

applying the first heating pulse with the first pulse width that has been set; and applying the second heating pulse with the second pulse width that has been set.

15. The method according to claim 14, wherein the applying one or more heating pulses further includes:

setting a first time and a second time in response to the command to print the one dot, the first time being a time when the first heating pulse starts to be applied, and the second time being a time when the second heating pulse starts to be applied;

applying the first heating pulse with the first pulse width at the first time that has been set; and applying the second heating pulse with the second pulse width at the second time that has been set.

16. The method according to claim 14, further comprising the step of acquiring printing data, wherein the applying one or more heating pulses further includes:

setting the first pulse width and the second pulse width, based on the printing data that have been acquired, in accordance with whether at least one dot that is adjacent to the one dot to be printed by the one of the plurality of heating elements is a print dot or an unprinted dot.

17. The method according to claim 16, wherein the applying one or more heating pulses further includes:

applying one of the first heating pulse and the second heating pulse, based on the printing data that have been acquired, in response to a command to print one dot that is a final dot among a plurality of dots that is to be printed consecutively on the printing medium in the sub-scanning direction.

18. The method according to claim 16, the method further comprising the step of acquire a temperature that has been detected by a temperature detecting portion of the printer, the temperature being a temperature in an area around the printing portion, wherein the applying one or more heating pulses further includes:

setting the first pulse width and the second pulse width based on the printing data that have been acquired and on the temperature that has been acquired.

* * * * *